US007501623B2

(12) United States Patent
Tong et al.

(10) Patent No.: US 7,501,623 B2
(45) Date of Patent: Mar. 10, 2009

(54) TWO-DIMENSIONAL ELECTRODE CONSTRUCTIONS FOR ION PROCESSING

(75) Inventors: Roger Tong, Berkeley, CA (US); Mingda Wang, Fremont, CA (US); Gregory J. Wells, Fairfield, CA (US)

(73) Assignee: Varian, Inc., Palo Alto, CA (US)

( * ) Notice: Subject to any disclaimer, the term of this patent is extended or adjusted under 35 U.S.C. 154(b) by 430 days.

(21) Appl. No.: 11/342,485

(22) Filed: Jan. 30, 2006

(65) Prior Publication Data

US 2007/0176095 A1 Aug. 2, 2007

(51) Int. Cl.
*H01J 49/42* (2006.01)

(52) U.S. Cl. ..... 250/292; 250/282; 250/291; 250/283; 250/396 R

(58) Field of Classification Search ..... 250/282, 250/292, 291, 283, 396 R
See application file for complete search history.

(56) References Cited

U.S. PATENT DOCUMENTS

| | | | | |
|---|---|---|---|---|
| 5,420,425 | A * | 5/1995 | Bier et al. | 250/292 |
| 5,886,346 | A | 3/1999 | Makarov | |
| 6,087,658 | A | 7/2000 | Kawato | |
| RE36,906 | E * | 10/2000 | Franzen et al. | 250/292 |
| 6,608,303 | B2 * | 8/2003 | Amy et al. | 250/292 |
| 6,723,986 | B2 | 4/2004 | Kernan et al. | |
| 6,797,950 | B2 | 9/2004 | Schwartz et al. | |
| 6,831,275 | B2 * | 12/2004 | Franzen et al. | 250/292 |
| 6,838,666 | B2 * | 1/2005 | Ouyang et al. | 250/292 |
| 6,936,815 | B2 * | 8/2005 | Tehlirian et al. | 250/292 |
| 6,995,366 | B2 * | 2/2006 | Franzen | 250/292 |
| 7,180,057 | B1 * | 2/2007 | Senko et al. | 250/282 |
| 7,279,681 | B2 * | 10/2007 | Li et al. | 250/292 |
| 2002/0185596 | A1 | 12/2002 | Amy et al. | |
| 2003/0183759 | A1 * | 10/2003 | Schwartz et al. | 250/292 |

(Continued)

FOREIGN PATENT DOCUMENTS

| | | |
|---|---|---|
| WO | WO 02/091427 | 11/2002 |

(Continued)

OTHER PUBLICATIONS

Article by Schwartz, et al., entitled "A Two-Dimensional Quadrupole Ion Trap Mass Spectrometer", published by J Am Soc Mass Spectrom 2002, 13, pp. 659-669.

*Primary Examiner*—Jack I Berman
*Assistant Examiner*—Michael J Logie
(74) *Attorney, Agent, or Firm*—Bella Fishman

(57) ABSTRACT

An electrode for use in a device such as an ion trap has an axial length extending generally in the direction of a central axis from a first axial end to a second axial end, and an inside surface. The inside surface includes a surface profile that is uniform from the first axial end to the second axial end, or at least is uniform for a uniform section length along the axial direction. The electrode may include an elongated surface feature such as a groove that extends for at least the uniform section length. An aperture may communicate with the groove. The electrode may be axially segmented into regions. Gaps between the regions may be oriented at an angle relative to a plane orthogonal to the central axis. The electrode may be one of several electrodes arranged as an electrode structure coaxially disposed about an elongated interior space.

21 Claims, 14 Drawing Sheets

U.S. PATENT DOCUMENTS

| | | | | |
|---|---|---|---|---|
| 2004/0195504 | A1* | 10/2004 | Senko et al. | 250/291 |
| 2004/0245460 | A1* | 12/2004 | Tehlirian et al. | 250/292 |
| 2005/0167584 | A1* | 8/2005 | Kernan et al. | 250/290 |
| 2005/0263696 | A1* | 12/2005 | Wells | 250/292 |

FOREIGN PATENT DOCUMENTS

| | | |
|---|---|---|
| WO | WO 2007/019293 | 2/2007 |

* cited by examiner

TWO-DIMENSIONAL ELECTRODE CONSTRUCTIONS FOR ION PROCESSING

CROSS-REFERENCE TO RELATED APPLICATIONS

This application is related to the following co-pending U.S. Patent Applications and issued U.S. Patents, which are commonly assigned to the assignee of the present disclosure: U.S. application Ser. No. 11/342,895, filed on Jan. 30, 2006 and titled "Compensating for Field Imperfections in Linear Ion Processing Apparatus", U.S. Pat. No. 7,405,500, issued on Jul. 29, 2008 and titled "Adjusting Field Conditions in Linear Ion Processing Apparatus for Different Modes of Operation", U.S. Pat. No. 7,405,399, issued on Jul. 29, 2008 and titled "Field Conditions for Ion Excitation in Linear Processing Apparatus", and U.S. Pat. No. 7,351,965, issued on Apr. 1, 2008 and titled "Rotating Excitation Field in Linear Ion Processing Apparatus", each of which is being filed concurrently with the present application on Jan. 30, 2006.

FIELD OF THE INVENTION

The present invention relates generally to electrode structures, such as electrodes and sets of electrodes, of two-dimensional or linear geometry that may be employed in the manipulation or processing of ions. The invention also relates to methods and apparatus for the manipulation or processing of ions in which the electrode structures may be utilized. The electrode structures may be employed, for example, in conjunction with mass spectrometry-related operations.

BACKGROUND OF THE INVENTION

A linear or two-dimensional ion-processing device such as an ion trap is formed by a set of elongated electrodes coaxially arranged about a central (z) axis of the device and elongated in the direction of the central axis. Typically, each electrode is positioned in the (x-y) plane orthogonal to the central axis at a radial distance from the central axis. The inside surfaces of the electrodes are typically hyperbolic with apices facing inwardly toward the central axis. The resulting arrangement of electrodes defines an axially elongated interior space of the device between opposing inside surfaces. In operation, ions may be introduced, trapped, stored, isolated, and subjected to various reactions in the interior space, and may be ejected from the interior space for detection. Such manipulations require precise control over the motions of ions present in the interior space, as well as over the geometry, fabrication and assembly of the physical components of the electrode structure. The radial excursions of ions along the x-y plane may be controlled by applying a two-dimensional RF trapping field between opposing pairs of electrodes. The axial excursions of ions, or the motion of ions along the central axis, may be controlled by applying an axial DC trapping field between the axial ends of the electrodes. Additionally, auxiliary or supplemental RF fields may be applied between an opposing pair of electrodes to increase the amplitudes of oscillation of ions of selected mass-to-charge ratios along the axis of the electrode pair and thereby increase the kinetic energies of the ions for various purposes, including ion ejection and collision-induced dissociation (CID).

Ions present in the interior space of the electrode set are responsive to, and their motions influenced by, electric fields active within the interior space. These fields include fields applied intentionally by electrical means as in the case of the above-noted DC and RF fields, and fields inherently (mechanically) generated due to the physical/geometric features of the electrode set. The inherently generated fields may or may not be intentional and, depending on the mode of operation, may or may not be desirable or optimal. The applied fields are not only governed by their applied operating parameters (amplitude, frequency, phase, and the like) but also by the size of the electrode set including the spacing between the electrodes. The inherently generated fields are also governed by the size and spacing of the electrodes. Both applied fields and inherently generated fields are governed by the configuration (profile, geometry, features, and the like) of the inside surfaces of the electrodes exposed to the interior space. Points on the inside surfaces closest to the central axis, such as the apical line of a hyperbolic electrode, have the greatest influence on an RF trapping field and thus on the ions that are constrained by the RF trapping field to the volume around the central axis.

In an ideal case, the physical features and geometry of the electrodes would be perfect such that no imperfections in the active fields existed and the fields would be uniform along the central axis of the electrode set. The electrodes would be perfect hyperbolic surfaces extending to infinity toward the asymptotes. The response of ions to the fields would be completely predictable and controllable, and the performance of the device as a mass analyzer or the like could be completely optimized. In practice, however, the electrodes contain a number of different features that engender various types of field faults or distortions that can adversely affect the manipulation and behavior of ions. For example, most electrode sets employed as ion traps eject ions from the interior space in a radial (x or y) direction orthogonal to the central axis. In many applications, radial ejection is most efficient when effected directly along the axis on which two opposing electrodes are positioned. Radial ejection through an electrode requires the electrode to have an ion exit aperture, which is typically shaped as a slot elongated in the axial (z) direction. The slot can be a significant source of field faults that are detrimental to the desired manipulation and processing of ions during certain stages of operation. Therefore, it would be advantageous to eliminate or at least minimize field faults created by slots.

In prior art configurations, the length of the slot is significantly shorter than the overall length of the electrode so that ions being ejected are kept away from the axial ends of the electrode where detrimental field distortions are often pronounced. Various other design considerations have been proposed to minimize the effects of the slot, such as minimizing the size or cross-sectional area (e.g., length and width) of the slot, maximizing the uniformity of the cross-sectional area of the slot, altering other physical features of the electrodes or providing additional physical features to compensate for the presence of the slot, and the like. Despite the foregoing, the mere presence of the slot creates field distortions because the edges of the slot constitute geometric discontinuities. Consequently, the fields active in the vicinity of the slot are different than the fields in other regions of the electrode set. Any differences in a field relative to axial position along the central axis of the electrode set can adversely affect the desired response of the ions and consequently the performance of the electrode set as an ion-processing device. For instance, when the electrode set is employed as an ion-trap mass analyzer, non-uniformity in the field along the central axis can cause ions of the same mass-to-charge ratio to be ejected at different instances of time, resulting in a loss in mass resolution.

In view of the foregoing, it would be advantageous to provide electrode structures for use in ion-processing devices that better address the problems associated with the inclusion of apertures in such electrodes as well as other sources of detrimental field effects in the electrode set, or that improve the uniformity of electric fields generated with the use of the electrode structures.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an electrode structure for manipulating ions is provided. The electrode structure comprises a plurality of electrodes coaxially disposed about a central axis. Each electrode has an axial length extending generally in the direction of the central axis. Each electrode includes a first axial end, a second axial end, an outside surface generally facing away from an interior space of the electrode structure, and an inside surface generally facing the interior space and axially extending from the first axial end to the second axial end. At least one of the electrodes is an apertured electrode having an aperture radially extending from the inside surface to the outside surface. The inside surface of the apertured electrode includes a surface profile. The surface profile is uniform along the axial direction from the first axial end to the second axial end.

According to another implementation, the aperture axially extends from the first axial end to the second axial end of the apertured electrode.

According to another implementation, the inside surface of the apertured electrode includes an elongated surface feature extending from the first axial end to the axial end. In one implementation, the elongated surface feature includes a groove that communicates with the aperture.

According to another implementation, the electrode structure further comprises a first end electrode section and a second end electrode section axially spaced from the first end electrode section along the central axis. The plurality of electrodes is axially interposed between the first end electrode section and the second end electrode section.

According to another implementation, each electrode is segmented into a first end section, a central section axially spaced from the first end section, and a second end section axially spaced from the central section. The surface profile of the inside surface of the apertured electrode is uniform along the axial direction from the first axial end to the second axial end of the central section of the apertured electrode. The uniformity of the surface profile continues along the axial direction over at least a portion of the first end section of the apertured electrode nearest to the first axial end of the center section, and over at least a portion of the second end section of the apertured electrode nearest to the second axial end of the center section.

According to another implementation, the uniformity of the surface profile continues along the axial direction over the entire length of the first end section of the apertured electrode and over the entire length of the second end section of the apertured electrode.

According to another implementation, the apertured electrode includes a cross-section in a plane orthogonal to the central axis and defined by a radial axis and a transverse axis. The cross-section has a width along the transverse axis and a depth along the radial axis. The aperture radially extends along the radial axis at the center of the width. The cross-section includes a uniform cross-sectional portion transversely centered with the aperture and radially extending from the inside surface into the apertured electrode over a portion of the depth. The uniform cross-sectional portion is uniform along the axial direction from the first axial end to the second axial end of the apertured electrode.

According to another implementation, the apertured electrode includes a cross-section in a plane facing the interior space and defined by the axial length of the apertured electrode and a transverse axis oriented orthogonally relative to the central axis. The cross-section has a width along the transverse axis. The plurality of electrodes includes an opposing electrode disposed opposite to the apertured electrode relative to the central axis. The opposing electrode includes a cross-section in a plane facing the interior space and opposite to the cross-section of the apertured electrode. The respective cross-sections of the apertured electrode and the opposite electrode are the same along the axial direction from the first axial ends to the second axial ends of the respective apertured electrode and the opposite electrode.

According to another implementation, an electrode structure for manipulating ions is provided. The electrode structure comprises a plurality of electrodes coaxially disposed about a central axis. Each electrode has an axial length extending generally in the direction of the central axis. Each electrode includes a first axial end, a second axial end, an outside surface generally facing away from an interior space of the electrode structure, and an inside surface generally facing the interior space and axially extending from the first axial end to the second axial end. At least one of the electrodes is an apertured electrode having an aperture axially extending in the axial direction and radially extending from the inside surface to the outside surface. The inside surface of the apertured electrode includes a surface profile. The surface profile is uniform along a uniform section length, and the uniform section length is greater than the axial length of the aperture.

According to another implementation, the inside surface of the apertured electrode includes an elongated surface feature extending along the uniform section length. In one implementation, the elongated surface feature includes a groove that communicates with the aperture.

According to another implementation, an electrode for generating an electric field in a ion processing device is provided. The electrode includes a first axial end, a second axial end, and an elongated length extending from the first axial end to the second axial end. The electrode further includes an outer surface extending from the first axial end to the second axial end. The outer surface includes a curved section extending from the first axial end to the second axial end. The curved section includes an apical region generally centered about an apical line, and includes an elongated surface feature extending from the first axial end to the second axial end in alignment with the apical line. In one implementation, the elongated surface feature includes an aperture radially extending from the curved section through a thickness of the electrode in alignment with the apical line, and axially extending from the first axial end to the second axial end. In another implementation, the elongated surface feature includes a groove radially extending into the electrode, and axially extending from the first axial end to the second axial end. In another implementation, the elongated surface feature includes the groove, and the electrode has an aperture communicating with the groove.

According to another implementation, an electrode for generating an electric field in a ion processing device is provided. The electrode comprises a body. The body includes a first axial end, an opposing second axial end, and an elongated length extending from the first axial end to the second axial end. The body further includes a thickness lying in a cross-sectional plane orthogonal to the elongated length, and an outer surface extending from the first axial end to the second axial end. The outer surface includes a curved section extending from the first axial end to the second axial end. The body is segmented into a first end section, a central section axially spaced from the first end section by a first gap, and a second end section axially spaced from the central section by a second gap. At least a portion of the first gap and at least a portion of the second gap are oriented at an angle relative to the cross-sectional plane. In one implementation, the curved section includes an elongated surface feature axially extending along the entire length of the central section.

According to one aspect of the electrode with the segmented body, the first end section includes a first end section inside face, the central section includes a first central section inside face and an opposing second central section inside face, and the second end section includes a second end section inside face. Each of the first end section inside face, the first central section inside face, the second central section inside face, and the second end section inside face is curved relative to the orthogonal plane.

According to another aspect of the electrode with the segmented body, the central section includes a first reduced-width end region and an opposing second reduced-width end region, the first end section includes a first recessed region receiving the first reduced-width end region and separated from the first reduced-width end region by the first gap, and the second end section includes a second recessed region receiving the second reduced-width end region and separated from the second reduced-width end region by the second gap.

DETAILED DESCRIPTION OF THE INVENTION

In general, the term "communicate" (for example, a first component "communicates with" or "is in communication with" a second component) is used herein to indicate a structural, functional, mechanical, electrical, optical, magnetic, ionic or fluidic relationship between two or more components (or elements, features, or the like). As such, the fact that one component is said to communicate with a second component is not intended to exclude the possibility that additional components may be present between, and/or operatively associated or engaged with, the first and second components.

The subject matter provided in the present disclosure generally relates to electrodes and arrangements of electrodes of the type provided in apparatus employed for manipulating, processing, or controlling ions. The electrode arrangements may be utilized to implement a variety of functions. As non-limiting examples, the electrode arrangements may be utilized as chambers for ionizing neutral molecules; lenses or ion guides for focusing, gating and/or transporting ions; devices for cooling or thermalizing ions; devices for trapping, storing and/or ejecting ions; devices for isolating desired ions from undesired ions; mass analyzers or sorters; mass filters; stages for performing tandem or multiple mass spectrometry (MS/MS or $MS^n$); collision cells for fragmenting or dissociating precursor ions; stages for processing ions on either a continuous-beam, sequential-analyzer, pulsed or time-sequenced basis; ion cyclotron cells; and devices for separating ions of different polarities. However, the various applications of the electrodes and electrode arrangements described in the present disclosure are not limited to these types of procedures, apparatus, and systems. Examples of electrodes and electrode arrangements and related implementations in apparatus and methods are described in more detail below with reference to FIGS. 1-9.

Figure 1:
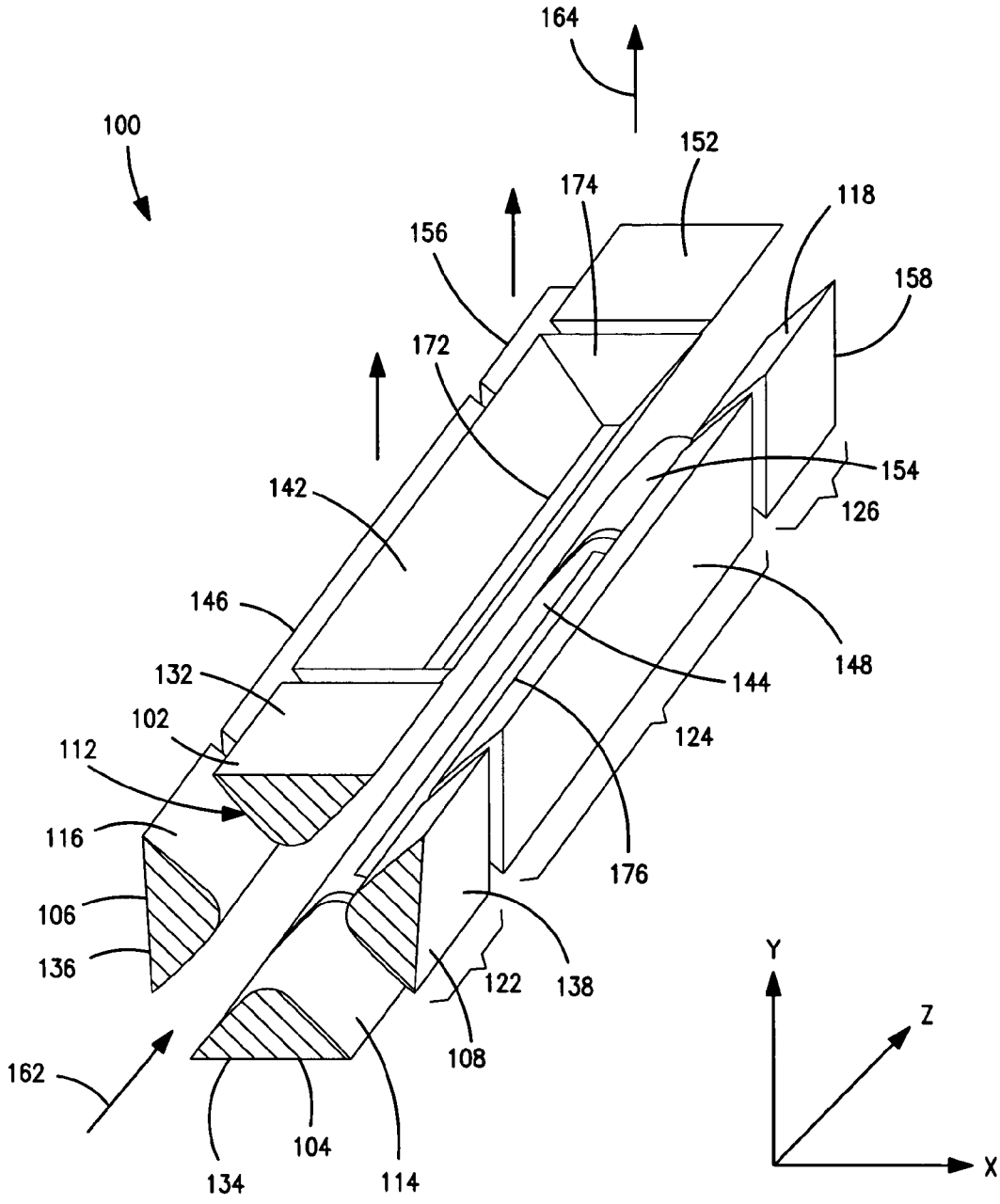
FIG. 1 is a perspective view of an example of an electrode structure provided according to implementations described in the present disclosure.
Figure 2:
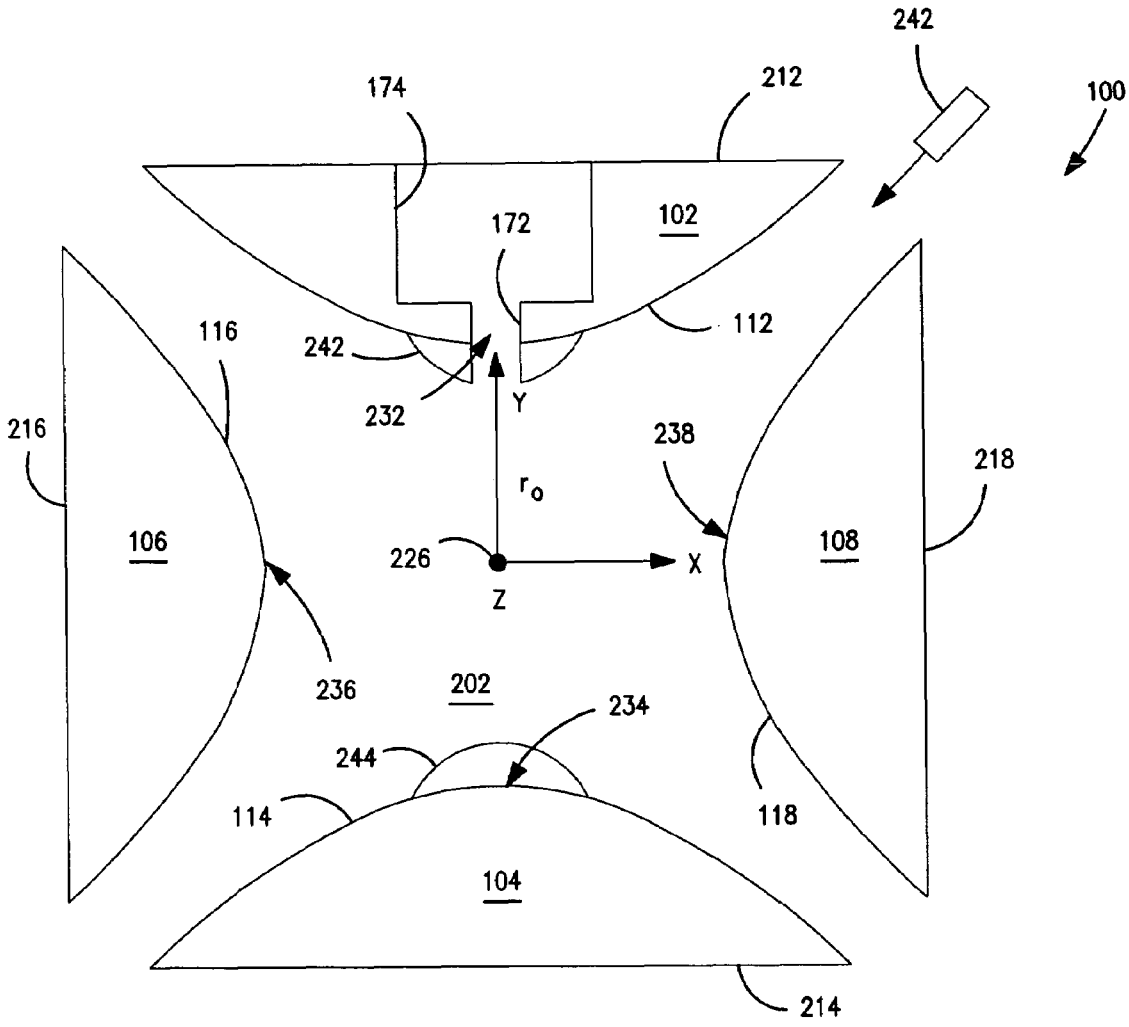
FIG. 2 is a cross-sectional view of the electrode structure illustrated in FIG. 1, taken in a radial plane orthogonal to the central axis of the electrode structure.
Figure 3:
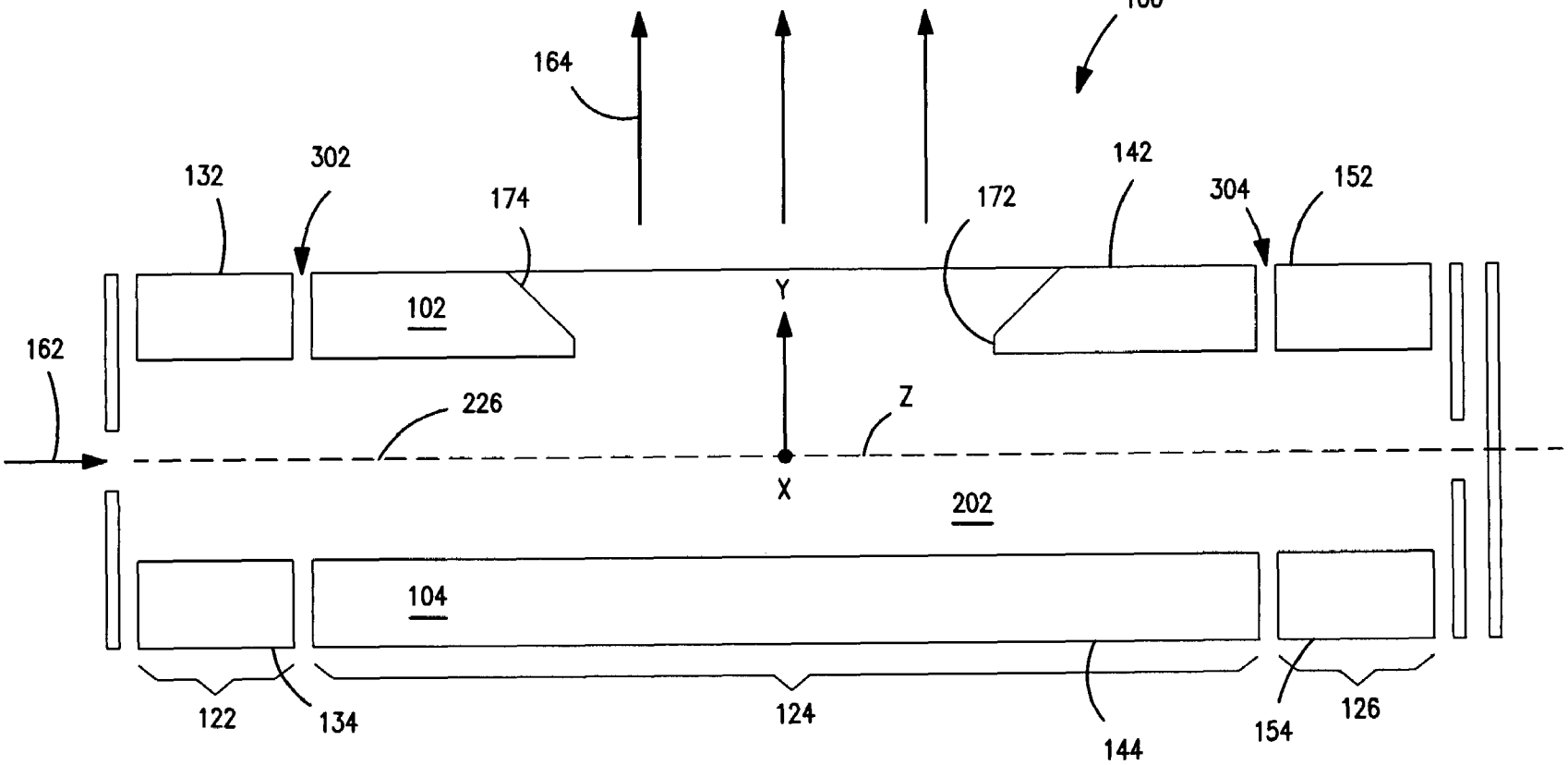
FIG. 3 is a cross-sectional view of the electrode structure illustrated in FIG. 1, taken in an axial plane orthogonal to the central axis.

FIGS. 1-3 illustrate an example of an electrode structure, arrangement, system, or device or rod set 100 of linear (two-dimensional) geometry that may be utilized to manipulate or process ions. FIGS. 1-3 also include a Cartesian (x, y, z) coordinate frame for reference purposes. For descriptive purposes, directions or orientations along the z-axis will be referred to as being axial, and directions or orientations along the orthogonal x-axis and y-axis will be referred to as being radial or transverse. FIGS. 4-8 illustrate additional examples of electrodes that may be provided with the electrode structure 100.

Referring to FIG. 1, the electrode structure 100 includes a plurality of electrodes 102, 104, 106 and 108 that are elongated along the z-axis. That is, each of the electrodes 102, 104, 106 and 108 has a dominant or elongated dimension (for example, length) that extends in directions generally parallel with the z-axis. In many implementations, the electrodes 102, 104, 106 and 108 are exactly parallel with the z-axis or as parallel as practicably possible. This parallelism can enable better predictability of and control over ion behavior during operations related to the manipulation and processing of ions in which RF fields are applied to the electrode structure 100, because in such a case the strength (amplitude) of an RF field encountered by an ion does not change with the axial position of the ion in the electrode structure 100. Thus, assuming no other field defects, the value of the Mathieu parameter q of the ion will not depend on axial position. When the value for q is independent of axial position, ions can be ejected from the electrode structure 100 on a purely mass-dependent basis without their axial positions contributing to broadening of the mass spectral peaks or concomitant degradation of mass resolution in the output data. Moreover, with parallel electrodes 102, 104, 106 and 108, the magnitude of a DC potential applied end-to-end to the electrode structure 100 does not change with axial position.

In the example illustrated in FIG. 1, the plurality of electrodes 102, 104, 106 and 108 includes four electrodes: a first electrode 102, a second electrode 104, a third electrode 106, and a fourth electrode 108. In the present example, the first electrode 102 and the second electrode 104 are generally arranged as an opposing pair along the y-axis, and the third electrode 106 and the fourth electrode 108 are generally arranged as an opposing pair along the x-axis. Accordingly, the first and second electrodes 102 and 104 may be referred to as y-electrodes, and the third and fourth electrodes 106 and 108 may be referred to as x-electrodes. This example is typical of quadrupolar electrode arrangements for linear ion traps as well as other quadrupolar ion processing devices. In other implementations, the number of electrodes 102, 104, 106 and 108 may be other than four. Each electrode 102, 104, 106 and 108 may be electrically interconnected with one or more of the other electrodes 102, 104, 106 and 108 as required for generating desired electrical fields within the electrode structure 100. As also shown in FIG. 1, the electrodes 102, 104, 106 and 108 include respective inside surfaces 112, 114, 116 and 118 generally facing toward the center of the electrode structure 100.

FIG. 2 illustrates a cross-section of the electrode structure 100 in the x-y plane. The electrode structure 100 has an interior space or chamber 202 generally defined between the electrodes 102, 104, 106 and 108. The interior space 202 is elongated along the z-axis as a result of the elongation of the electrodes 102, 104, 106 and 108 along the same axis. The inside surfaces 112, 114, 116 and 118 of the electrodes 102, 104, 106 and 108 generally face toward the interior space 202 and thus in practice are exposed to ions residing in the interior space 202. The electrodes 102, 104, 106 and 108 also include respective outside surfaces 212, 214, 216 and 218 generally facing away from the interior space 202. As also shown in FIG. 2, the electrodes 102, 104, 106 and 108 are coaxially positioned about a main or central longitudinal axis 226 of the electrode structure 100 or its interior space 202. In many implementations, the central axis 226 coincides with the geometric center of the electrode structure 100. Each electrode 102, 104, 106 and 108 is positioned at some radial distance $r_0$ in the x-y plane from the central axis 226. In some implementations, the respective radial positions of the electrodes 102, 104, 106 and 108 relative to the central axis 226 are equal. In other implementations, the radial positions of one or more of the electrodes 102, 104, 106 and 108 may intentionally differ from the radial positions of the other electrodes 102, 104, 106 and 108 for such purposes as introducing certain types of electrical field effects or compensating for other, undesired field effects.

Each electrode 102, 104, 106 and 108 has an outer surface, and at least a section of the outer surface may be curved. In the present example, the cross-sectional profile in the x-y plane of each electrode 102, 104, 106 and 108—or at least the shape of the inside surfaces 112, 114, 116 and 118—is curved. In some implementations, the cross-sectional profile in the x-y plane is generally hyperbolic to facilitate the utilization of quadrupolar ion trapping fields, as the hyperbolic profile more or less conforms to the contours of the equipotential lines that inform quadrupolar fields. The hyperbolic profile may fit a perfect hyperbola or may deviate somewhat from a perfect hyperbola. In some implementations, the deviation is intentionally done to modify field effects in a desired manner. In either case, each inside surface 112, 114, 116 and 118 is curvilinear and has a single point of inflection and thus a respective apex or vertex 232, 234, 236 and 238 that extends as a line along the z-axis. Each apex 232, 234, 236 and 238 is typically the point on the corresponding inside surface 112, 114, 116 and 118 that is closest to the central axis 226 of the interior space 202. In the present example, taking the central axis 226 as the z-axis, the respective apices 232 and 234 of the first electrode 102 and the second electrode 104 generally coincide with the y-axis, and the respective apices 236 and 238 of the third electrode 106 and the fourth electrode 108 generally coincide with the x-axis. In such implementations, the radial distance $r_0$ is defined between the central axis 226 and the apex 232, 234, 236 and 238 of the corresponding electrode 102, 104, 106 and 108.

In other implementations, the cross-sectional profiles of the electrodes 102, 104, 106 and 108 may have a non-ideal hyperbolic shape such as by including bumps or protrusions, such as a bump or protrusion 242 on the electrode 102 near the aperture 172, and/or a bump or protrusion 244 on the electrode 104 or other non-apertured electrode. Some advantages attending the provision of such bumps or protrusions 242 and 244 are described in co-pending U.S. patent application Ser. No. 10/855,760, filed May 26, 2004, titled "Linear Ion Trap Apparatus and Method Utilizing an Asymmetrical Trapping Field," which is commonly assigned to the assignee of the present disclosure. Similar bumps or protrusions have been provided in three-dimensional ion trap devices commercially available from Varian, Inc., Palo Alto, Calif., such as the Saturn® 2000 and Titan™ MS-4000 devices.

In other implementations, the cross-sectional profiles of the electrodes 102, 104, 106 and 108 may be some other non-ideal hyperbolic shape such as a circle, in which case the electrodes 102, 104, 106 and 108 may be characterized as being cylindrical rods. In still other implementations, the cross-sectional profiles of the electrodes 102, 104, 106 and 108 may be more rectilinear, in which case the electrodes 102, 104, 106 and 108 may be characterized as being curved plates. The terms "generally hyperbolic" and "curved" are intended to encompass all such implementations. In all such implementations, each electrode 102, 104, 106 and 108 may be characterized as having a respective apex 232, 234, 236 and 238 that faces the interior space 202 of the electrode structure 100.

As illustrated by way of example in FIG. 1, in some implementations the electrode structure 100 is axially divided into a plurality of sections or regions 122, 124 and 126 relative to the z-axis. In the present example, there are at least three regions: a first end region 122, a central region 124, and a second end region 126. Stated differently, the electrodes 102, 104, 106 and-108 of the electrode structure 100 may be considered as being axially segmented into respective first end sections 132, 134, 136 and 138, central sections 142, 144, 146 and 148, and second end sections 152, 154, 156 and 158. Accordingly, the first end electrode sections 132, 134, 136 and 138 define the first end region 122, the central electrode sections 142, 144, 146 and 148 define the central region 124, and the second end electrode sections 152, 154, 156 and 158 define the second end region 126. The first end electrode sections 132, 134, 136 and 138 and the second end electrode sections 152, 154, 156 and 158 may also be referred to as guard electrodes or outboard electrodes. The electrode structure 100 according to the present quadrupolar example may also be considered as including twelve axial electrodes 132, 134, 136, 138, 142, 144, 146, 148, 152, 154, 156, and 158. In other implementations, the electrode structure 100 may include more than three axial regions 122, 124 and 126.

FIG. 3 illustrates a cross-section of the electrode structure 100 in the y-z plane but showing only the y-electrodes 102 and 104. The elongated dimension of the electrode structure 100 along the central axis 226, the elongated interior space 202, and the optional axial segmentation of the electrode structure 100 are all clearly evident. Moreover, in the present example, it can be seen that the division of the electrode structure 100 into regions 122, 124 and 126 (or the segmentation of the electrodes 102, 104, 106 and 108 into respective sections) is a physical one. That is, respective gaps 302 and 304 (axial spacing) exist between adjacent regions or sections 122, 124 and 124, 126. In other implementations, the electrodes 102, 104, 106 and 108 are unitary or single-section structures, with no gaps 302 and 304 and no physically distinct regions 122, 124 and 126. However, axial segmentation provides advantages as discussed below.

In the operation of the electrode structure 100, a variety of voltage signals may be applied to one or more of the electrodes 102, 104, 106 and 108 to generate a variety of axially- and/or radially-oriented electric fields in the interior space 202 for different purposes related to ion processing and manipulation. The electric fields may serve a variety of functions such as injecting ions into the interior space 202, trapping the ions in the interior space 202 and storing the ions for a period of time, ejecting the ions mass-selectively from the interior space 202 to produce mass spectral information, isolating selected ions in the interior space 202 by ejecting unwanted ions from the interior space 202, promoting the dissociation of ions in the interior space 202 as part of tandem mass spectrometry, and the like.

For example, one or more DC voltage signals of appropriate magnitudes may be applied to the electrodes 102, 104, 106 and 108 and/or axial end-positioned lenses or other conductive structures to produce axial (z-axis) DC potentials for controlling the injection of ions into the interior space 202. In some implementations, ions are axially injected into the interior space 202 via the first end region 122 generally along the z-axis, as indicated by the arrow 162 in FIGS. 1 and 3. The electrode sections 132, 134, 136 and 138 of the first end region 122, and/or an axially preceding ion-focusing lens or multi-pole ion guide, may be operated as a gate for this purpose. Some advantages of axial injection are described in co-pending U.S. patent application Ser. No. 10/855,760, filed May 26, 2004, titled "Linear Ion Trap Apparatus and Method Utilizing an Asymmetrical Trapping Field," which is commonly assigned to the assignee of the present disclosure. Generally, however, the electrode structure 100 is capable of receiving ions in the case of external ionization, or neutral molecules or atoms to be ionized in the case of internal or in-trap ionization, into the interior space 202 in any suitable manner and via any suitable entrance location. Alternatives include radial injection through a space between adjacent electrodes 102, 104, 106 and 108 or through an aperture formed in one of the electrodes 102, 104, 106 or 108. These alternatives, however, are often considered to be disadvantageous when previously produced ions are being injected (external ionization), due to the ions encountering fringe fields, energy barriers, and other conditions that may impair injection or cause unwanted ejection or annihilation/neutralization of injected ions.

Once ions have been injected or produced in the interior space 202, the DC voltage signals applied to one or more of the regions 122, 124 and 126 and to axially preceding and succeeding lenses or other conductive structures may be appropriately adjusted to prevent the ions from escaping out from the axial ends of the electrode structure 100. In addition, the DC voltage signals may be adjusted to create an axially narrower DC potential well that constrains the axial (z-axis) motion of the injected ions to a desired region within the interior space 202. For example, the DC voltage levels at the end regions 122 and 126 may be set to be higher or lower than the DC voltage level at the central region 124 to create a centrally-located potential well, depending on the polarity of the ions being processed.

In addition to DC potentials, RF voltage signals of appropriate amplitude and frequency may be applied to the electrodes 102, 104, 106 and 108 to generate a two-dimensional (x-y), main RF quadrupolar trapping field to constrain the motions of stable (trappable) ions of a range of mass-to-charge ratios (m/z ratios, or simply "masses") along the radial directions. For example, the main RF quadrupolar trapping field may be generated by applying an RF signal to the pair of opposing y-electrodes 102 and 104 and, simultaneously, applying an RF signal of the same amplitude and frequency as the first RF signal, but 1800 out of phase with the first RF signal, to the pair of opposing x-electrodes 106 and 108. The combination of the DC axial barrier field and the main RF quadrupolar trapping field forms the basic linear ion trap in the electrode structure 100.

Because the components of force imparted by the RF quadrupolar trapping field are typically at a minimum at the central axis 226 of the interior space 202 of the electrode structure 100 (assuming the electrical quadrupole is symmetrical about the central axis 226), all ions having m/z ratios that are stable within the operating parameters of the quadrupole are constrained to movements within an ion-occupied volume or cloud in which the locations of the ions are distributed generally along the central axis 226. Hence, this ion-occupied volume is elongated along the central axis 226 but may be much smaller than the total volume of the interior space 202. Moreover, the ion-occupied volume may be axially centered with the central region 124 of the electrode structure 100 through application of the non-quadrupolar DC trapping field that includes the above-noted axial potential well. In many implementations, the well-known process of ion cooling or thermalizing may further reduce the size of the ion-occupied volume. The ion cooling process entails introducing a suitable inert background gas such as helium into the interior space 202. Collisions between the ions and the gas molecules cause the ions to give up kinetic energy, thus damping their excursions. As illustrated in FIG. 2, any suitable gas source 242, communicating with any suitable opening of the electrode structure 100 or enclosure of the electrode structure 100, may be provided for this purpose. Collisional cooling of ions may reduce the effects of field faults and improve mass resolution to some extent.

In addition to the DC and main RF trapping signals, additional RF voltage signals of appropriate amplitude and frequency (both typically less than the main RF trapping signal) may be applied to at least one pair of opposing electrodes 102/104 or 106/108 to generate a supplemental RF dipolar excitation field that resonantly excites trapped ions of selected m/z ratios. The supplemental RF field is applied while the main RF field is being applied, and the resulting superposition of fields may be characterized as a combined or composite RF field. Resonance excitation may be employed to promote or facilitate collision-induced dissociation (CID)

or other ion-molecule interactions, or reactions with a reagent gas. In addition, the strength of the excitation field component may be adjusted high enough to enable ions of selected masses to overcome the restoring force imparted by the RF trapping field and be ejected from the electrode structure 100 for elimination, ion isolation, or mass-selective scanning and detection. Thus, in some implementations, ions may be ejected from the interior space 202 along a direction orthogonal to the central axis 226, i.e., in a radial direction in the x-y plane. For example, as shown in FIGS. 1 and 3, ions may be ejected along the y-axis as indicated by the arrows 164. It will be understood, however, that dipolar resonant excitation is but one example of a technique for increasing the amplitudes of ion motion and radially ejecting ions from a linear ion trap. Other techniques are known and applicable to the electrode structures described in the present disclosure, as well as techniques or variations of known techniques not yet developed.

To facilitate radial ejection, one or more apertures may be formed in one or more of the electrodes 102, 104, 106 or 108. In the specific example illustrated in FIGS. 1-3, an aperture 172 is formed in one of the y-electrodes 102 to facilitate ejection in a direction along the y-axis in response to a suitable supplemental RF dipolar field being produced between the y-electrodes 102 and 104. The aperture 172 may be elongated along the z-axis, in which case the aperture 172 may be characterized as a slot or slit, to account for the elongated ion-occupied volume produced in the elongated interior space 202 of the electrode structure 100. In practice, a suitable ion detector (not shown) may be placed in alignment with the aperture 172 to measure the flux of ejected ions. To maximize the number of ejected ions that pass completely through the aperture 172 without impinging on the peripheral walls defining the aperture 172 and thus reach the ion detector, the aperture 172 may be centered along the apex 232 (FIG. 2) of the electrode 102, the cross-sectional area of the aperture 172 available for ion ejection may be uniform, and the depth of the aperture 172 through the thickness of the electrode 102 may be optimized. A recess 174 may be formed in the electrode 102 that extends from the outside surface 212 (FIG. 2) to the aperture 172 and surrounds the aperture 172 to minimize the radial channel or depth of the aperture 172 through which the ejected ions must travel. Such a recess 174, if provided, may be considered as being part of the outside surface 212.

To maintain a desired degree of symmetry in the electrical fields generated in the interior space 202, another aperture 176 may be formed in the electrode 104 opposite to the electrode 102 even if another corresponding ion detector is not provided. Likewise, apertures may be formed in all of the electrodes 102, 104, 106 and 108. In some implementations, ions may be preferentially ejected in a single direction through a single aperture by providing an appropriate superposition of voltage signals and other operating conditions, as described in the above-cited U.S. patent application Ser. No. 10/855,760.

Generally, as compared to linear ion traps that employ single-section electrodes in combination with end plates as focusing lenses, the axial segmentation of the electrode structure 100 illustrated in FIGS. 1-3 into physically distinct regions 122, 124 and 126 is considered advantageous for many implementations of ion trapping and mass analysis. In the case of electrode structures employing single-section electrodes, the DC axial trapping potential must be generated by applying DC voltage signals to end lenses positioned at each axial end of the electrode structure. In the vicinity of these end lenses, non-linear fringe distortions or perturbations exist in the radial trapping and excitation fields applied to the electrode structure due to significant structural/geometrical and electrical field discontinuities present at these locations. These fringe fields can have adverse effects on ions in the electrode structure. See, e.g., U.S. patent application Ser. No. 10/855,760, cited above; Schwartz et al., "A Two-Dimensional Quadrupole Ion Trap Mass Spectrometer," J. Am. Soc. Mass. Spectrom., Vol. 13, 659-669 (April 2002); and U.S. Pat. No. 6,797,950. For instance, the fringe fields may cause axial and radial excitation of ions that leads to unwanted, untimely ejection of those ions. Moreover, the fringe fields may render the response of ions to applied fields difficult to predict and control, due to the coupling of ion motions along different directions and the shifting of the secular frequencies of ions associated with their motions along different axes.

On the other hand, in the axially-segmented electrode structure 100 illustrated in FIGS. 1-3, the central region 124 is physically interposed between the end regions 122 and 126. By this configuration, the central region 124 is situated remotely from the axial ends of the electrode structure 100 and any lenses or other electrically conductive features axially external to the electrode structure 100. The various DC and RF signals applied at each region 122, 124 and 126 of the electrode structure 100 may be individually tailored, allowing the central region 124 to function as the analyzing section of the electrode structure 100 if desired. For instance, ions may be both axially and radially constrained (trapped) in the central region 124 and mass-selective ejection may be effected solely through the aperture 172 of the central region 124. Thus, the axial segmentation of the electrode structure 100 may facilitate the processing and manipulating of the ions while avoiding undesired influences from end-located fringe fields.

The use of axial segmentation, however, only partially addresses the problems associated with field imperfections. Axial segmentation does not eliminate all sources of non-uniformity in the various fields employed in the operation of the electrode structure 100. Many structural features of electrodes structures such as the electrode structure 100 illustrated in FIGS. 1-3 can cause field distortions that detrimentally affect certain types of operations involving ion processing and manipulation. For instance, the regions at the interfaces between the central region 124 and the end regions 122 and 126 are sources of undesired field variations. The aperture or apertures 172 employed to eject ions from the central region 124 is another source of undesired field variations. The presence of gaps 302 and 304 between the regions 122, 124 and 126 and the presence of the aperture(s) 172 introduce field faults that distort the quadrupolar trapping field and can lead to poor resolution and mass accuracy. To a lesser extent, the necessary truncation (finite extent of physical dimensions) of the electrodes 102, 104, 106 and 108 also results in field faults.

One approach toward addressing these problems has been to minimize the dimensions (length and width) of the aperture 172. See, e.g., U.S. Pat. No. 6,797,950. However, there is a limit to such minimization. The ion trapping volume or cloud within the electrode structure 100 must be kept elongated to maintain an acceptable level of ion ejection/detection efficiency, as the size of the aperture 172 determines how many of the ions will actually be successfully ejected through the aperture 172 and reach the ion detector. While the DC voltages could be adjusted to axially compress the ion trapping volume, this can result in increased space charge and consequently shifts in mass spectral peaks. Another approach has been to stretch (increase) the distance between the opposing pair of the electrodes 102 and 104 that includes the aperture 172 to compensate for undesired field effects. Another approach has been to shape one or more of the electrodes 102, 104, 106 and 108 in ways that deviate from theoretically ideal parameters. See, e.g., U.S. Patent App. Pub. No. US 2002/0185596 A1; U.S. Pat. No. 6,087,658; and Schwartz et al., "A Two-Dimensional Quadrupole Ion Trap Mass Spectrometer," J. Am. Soc. Mass. Spectrom., Vol. 13, 659-669 (April 2002).

In addition to simply minimizing the size of the apertures 172, various other design considerations for apertures 172 have been proposed that attempt to optimize performance but provide only partial solutions. For example, to avoid the effects of fringe fields and improve mass resolution and accuracy, the axial length of an aperture 172 of a central electrode section 142 has been specified as a percentage of the overall length of the central electrode section 142, such as 80-95%. Additionally, the width of the aperture 172 has been specified as a small percentage of the radial distance $r_0$ from the central axis 226 of the interior space 202 of the electrode structure 100 to the apex 232 of the electrode 102, such as 5-10%. See U.S. Pat. No. 6,797,950.

As evident from the foregoing discussion, while the provision of an aperture 172 in an electrode 102, 104, 106 or 108 is beneficial for facilitating radial ejection of ions from the electrode structure 100, the presence of the aperture 172 may impair the performance of the electrode structure 100 as a linear ion trap, mass analyzer, or other device. Despite the implementation of design considerations such as those noted above, the mere presence of an aperture 172 in an electrode 102 of the electrode structure 100 nonetheless constitutes a geometrical discontinuity that may engender unwanted non-uniformities and other defects in the composite electrical field applied the electrode structure 100 at a given stage of operation. For instance, setting the axial length of the aperture 172 to be shorter than the overall axial length of the central electrode section 142 means that the field in the central region 124 of the electrode structure 100 will necessarily be different from the fields in the first end region 122 and the second end region 126. The edges defining the aperture 172 are discontinuities that exist as long as an aperture 172 is provided.

By way of example, the implementations of electrodes, electrode arrangements and related components and methods described below are provided to address these problems.

Figure 4:
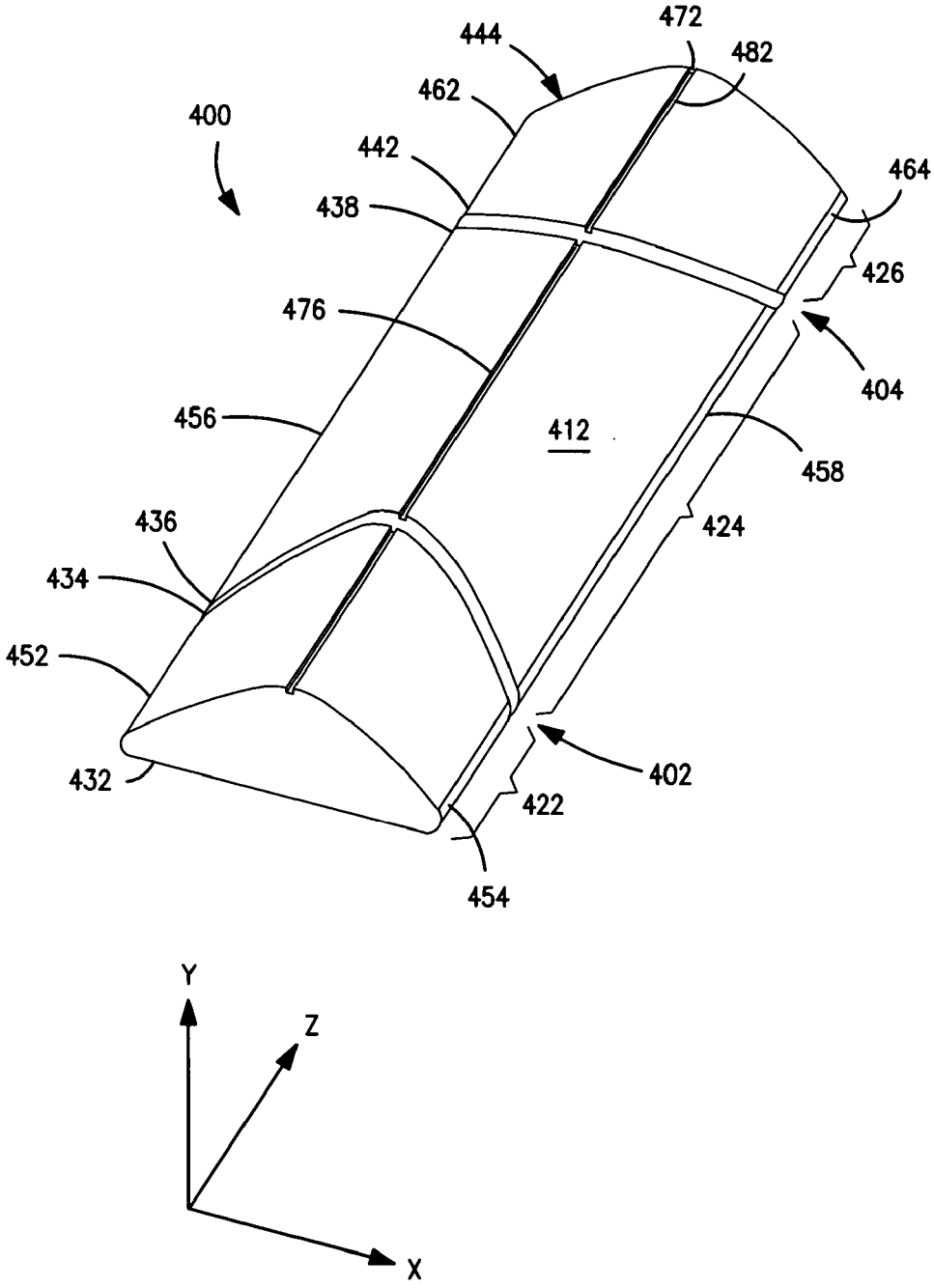
FIG. 4 is a perspective view of an example of an electrode provided in accordance with implementations described in the present disclosure.

FIG. 4 is a perspective view of an electrode 400 provided in accordance with one implementation of the present disclosure. The electrode 400 may be employed as one or more of the electrodes 102, 104, 106 and 108 of the electrode structure 100 illustrated in FIGS. 1-3 or in any other suitable linear arrangement of electrodes. FIG. 4 illustrates the electrode 400 from the perspective of its inside surface 412, which in practice is the part of the outer surface of the electrode 400 that faces the interior of an electrode set. In some implementations, the electrode 400 has a single-section or single-piece construction. In other implementations, as illustrated in FIG. 4, the electrode 400 may be axially segmented into a first end section 422, a central section 424, and a second end section 426, with respective gaps 402 and 404 defined between the adjacent sections 422, 424 and 424, 426. The first end section 422 includes a first axial end or end face 432 and an axially opposing second axial end or end face 434, the central section 424 includes a first axial end or end face 436 and an axially opposing second axial end or end face 438, and the second end section 426 includes a first axial end or end face 442 and an axially opposing second axial end or end face 444. The inside faces of the electrode sections 422, 424 and 426 define the gaps 402 and 404. Specifically, the second end face 434 of the first end section 422 and the first end face 436 of the central section 424 define the first gap 402, and the second end face 438 of the central section 424 and the first end face 442 of the second end section 426 define the second gap 404. In addition, the electrode 400 includes opposing outer edges or surfaces that extend along the z-axis. Accordingly, when axially segmented, the first end section 422 includes opposing outer edges 452 and 454, the central section 424 includes opposing outer edges 456 and 458, and the second end section 426 includes opposing outer edges 462 and 464. The sections of the inside surface 412 of the electrode 400 corresponding the first end section 422, the central section 424, and the second end section 426 are respectively bounded by the corresponding first and second end faces 432/434, 436/438 and 442/444, and the outer edges 452/454, 456/458, and 462/464.

At least a portion of the outer surface of the electrode 400 is a curved section. In the example shown in FIG. 4, the electrode 400, or at least its inside surface 412, has a generally curved or hyperbolic profile. The apex 472 of the profile may generally correspond to the centerline of the width of the electrode 400. Here, the width of the electrode 400 is generally defined as the transverse dimension between the outer edges (e.g., 452 and 454) of the electrode 400 (the x-direction in FIG. 4). When assembled as part of an electrode structure 100 (FIGS. 1-3) such as for a linear ion trap, the apex 472 is the portion of the inside surface 412 closest to the central axis 226 of the electrode structure 100. The electrode 400 may have an axially elongated surface feature such as an aperture or slot 476 that is generally collinear with the apex 472 or centerline of the electrode 400. The electrode 400 may thus be referred to as an apertured or aperture-containing electrode. In the illustrated example, the axial length of the aperture 476 is 100% of the axial length of the central electrode section 424 at the apex 472. That is, on the side of the electrode 400 that faces the interior space 202 of the electrode structure 100, the aperture 476 fully extends along the entire length of the central electrode section 424, from the first end face 436 of the central electrode section 424 to the second end face 438.

In one non-limiting example, the main electrode 400 has an axial length of approximately 70 mm and a transverse width of approximately 23 mm. The first end section 422 and the second end section 426 each have an axial length of approximately 19 mm at the apex and approximately 11 mm at the outer edge, and the central section 424 has an axial length of approximately 30 mm at the apex and approximately 38 mm at the outer edge. The gaps 402 and 404 each have an axial length of approximately 1 mm. The aperture 476 has an axial length of approximately 30 mm and a transverse width of approximately 0.5 mm.

In some implementations, as illustrated in FIG. 4, the end faces 436 and 438 of the central electrode section 424 are oriented at an oblique angle to the z-axis and to the x-y plane. The respective orientations of the end faces 436 and 438 are such that the axial length of the inside surface 412 of the central electrode section 424 is shorter at the apex 472 than at the outer edges 456 and 458. This configuration facilitates providing an aperture 476 whose length is 100% of the length of the inside surface 412 of the central electrode section 424. The second end face 434 of the first electrode section 422 and the first end face 442 of the second electrode section 426 are complementarily angled at the oblique angle to maintain geometrical uniformity and minimization of the gaps 402 and 404. The gaps 402 and 404 are thus also oriented at the oblique angle. In conventional segmented electrodes, the end faces and gaps are perpendicular to the z-axis, i.e., are completely flat and lie along the x-y plane.

Figure 5:
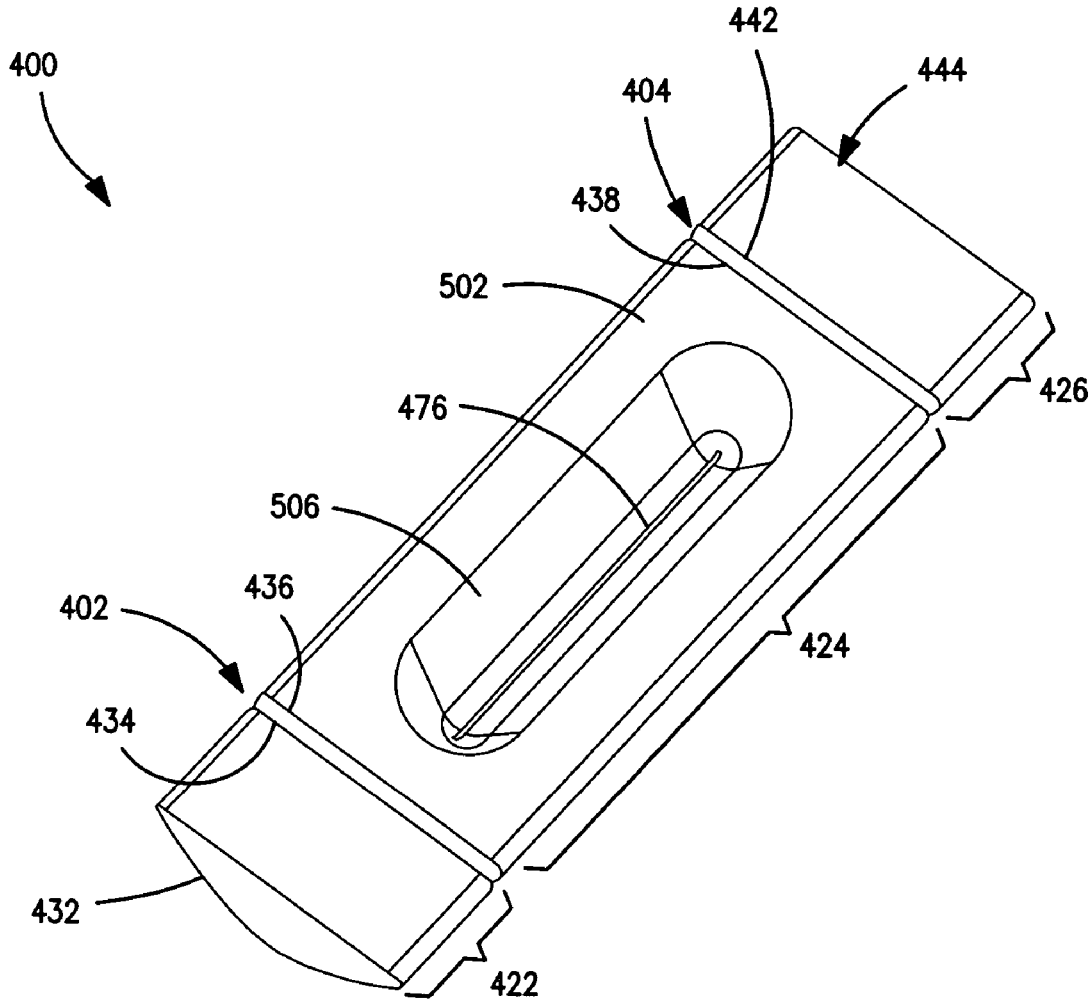
FIG. 5 is a perspective view of the electrode illustrated in FIG. 4, from an opposite side.

The segmentation of the electrode 400 at angles is further illustrated in FIG. 5, which illustrates the electrode 400 from the perspective of its outside surface 502 that is not exposed to the interior space 202 of the electrode structure 100 (FIGS. 2 and 3). As shown in FIG. 5, the axial length of the aperture 476 on the outside of the electrode 400 may be shorter than the overall length of the central electrode section 424 from this outside perspective. However, the boundaries of the aperture 476 on the outside of the electrode 400 are not as critical as on the inside where the motions of ions are influenced by the applied fields. The axial length of the aperture 476 is still 100% of the length of the central electrode section 424 from the inside perspective, as shown in FIG. 4. It can be appreciated that the angled segmentation of the electrode 400 may facilitate the fabrication of the electrode 400 with the 100%-length aperture 476. Although the aperture 476 extends across the entire length of the inside surface 412 of central electrode section 424 (FIG. 4), the central electrode section 424 can still comprise a unitary or one-piece structure in accordance with this implementation.

Referring back to FIG. 4, in additional implementations, the electrode 400—or more particularly the section of the electrode 400 that would be exposed to interior space 202 of an assembled electrode structure 100 (FIGS. 2 and 3) such as the illustrated inside surface 412—includes a surface feature that is elongated along the axial dimension. In some implementations, the axially elongated surface feature is an axial groove 482 formed along the entire length of the electrode 400, from one end face 432 to the other end face 444 and across each electrode section 422, 424 and 426. Alternatively, the groove 482 may extend along only a portion of the main electrode 400. In implementations where the inside surface 412 of the electrode 400 has a curved or hyperbolic profile and the apex 472 of the profile is generally positioned along the centerline of the electrode 400, the groove 482 is generally located at the apex 472 of the inside surface 412. Accordingly, the portion of the groove 482 that spans the axial length of the central electrode section 424, or a shorter sub-portion of this portion, may serve as the aperture 476 or the beginning of the aperture 476 for ejecting ions from the interior space 202 of the electrode structure 100. From the axial groove 482, the depth of the aperture 476 is continued radially through the thickness of the electrode 400 to the outside surface 502 or to a recess 506 of the outside surface 502 if provided (FIG. 5). The groove 482, however, is continued axially across the first end electrode section 422 and the second end electrode section 426 even though these end sections 422 and 426 do not have apertures 476. The portions of the groove 482 spanning the first end electrode section 422 and the second end electrode section 426 extend into the thickness of these electrode sections 422 and 426 to some depth, but not far enough as to constitute through-bores or channels that communicate with the outer surface 502 of the electrode 400 as in the case of the aperture 476. For example, the depth of the groove 482 may be about the same as the width of the aperture 476, or it may be greater or less than the width of the aperture 476. In some implementations, the width of the groove 482 is the same or substantially the same as the width of the aperture 476. In a sense, the portions of the groove 482 spanning the end electrode sections 422 and 426 may be characterized as emulating the aperture 476 of the central electrode section 424, at least from the perspective of the interior space 202 of the electrode structure 100 and any ions residing in the interior space 202.

As noted above, the axial length of the groove 482 may be less than that of the entire the main electrode 400, and may be greater than, less than or equal to the axial length of the central electrode section 424 and, further, may be greater than the axial length of the aperture 476 if an aperture 476 is provided. In some implementations, the axial length of the groove 482 is about twice the axial length of the aperture 476 or greater and the aperture 476 is axially centered within the axial extent of the groove 482. These implementations are also useful, given that the most critical z-coordinates are in the vicinity of the aperture 476 through which the ions are ejected and susceptible to adverse field effects. In these implementations, the surface profile of the inside surface 412 is uniform over at least some uniform section length of the electrode 400 along the z-axis. The uniform section length corresponds to the axial extent of the elongated surface feature—or instance, the 100%-length aperture 476 or the groove 482 as described in the present disclosure.

In some implementations, the aperture 476 may be considered as being the portion of the groove 482 that spans the central electrode section 424. In other implementations, the aperture 476 and the groove 482 may be considered as being separate and distinct features, the groove 482 may be considered as being a feature of the inside surface 412, and thus the volume in the groove 482 may be considered as being part of the interior space 202 (FIGS. 2 and 3). It will also be noted that in implementations in which the aperture 476 and/or the groove 482 are aligned with the line of the apex 472 of the inside surface 412, the apex 472 may not actually be part of the solid body of the electrode 400. This is because the aperture 476 or groove 482 defines the boundaries of a space, or an absence of material. Hence, in these implementations, the apex 472 may be characterized as being located in space at the point of inflection of a curve extending beyond the inside surface 412. The aperture 472 and/or the groove 782 may be characterized as being located at the apex 432, in alignment with the apex 432, or in an apical region of the main electrode 400 near the apex 432.

As previously noted, ion motion within the interior space 202 of the electrode structure 100 is governed by the electric fields active in the interior space 202. These electric fields are thus determined at least in part by the configuration of the inside surface 412. From FIG. 4, it can be seen how implementations that provide a 100%-length aperture 476, an axial groove 482, or an axial groove 482 that effectively extends the axial length of an aperture 476 on the inside surface 412, improve field uniformity along the z-axis. Among other advantages, the 100%-length aperture 476 and/or the axial groove 482 effectively extend the length along the z-axis along which an RF field can be rendered approximately independent from the z-coordinate. Consider, for example, that the electrode 400 is a y-electrode having an aperture 476 through which ions are ejected in the y-direction. With the 100%-length aperture 476, the curved inside profile in the x-y plane of the central electrode section 424 remains uniform along the z-axis, i.e., is the same as any z-value, particularly in the region of the apex 472 that would be nearest to the center of a typical quadrupolar trapping field. This is also true for implementations in which the axial length of the aperture 476 is less than 100% of the axial length of the central electrode section 424 and, instead, an axial groove 482 is provided that is at least 100% of the axial length of the central electrode section 424. In implementations where the groove 482 extends along the entire axial length of the electrode 400, the inside profile in the x-y plane remains uniform along the entire length of the electrode 400, despite the presence of the aperture 476. Even implementations in which the axial groove 482 is less than 100% of the axial length of the central electrode section 424 but greater than the axial length of the aperture 476 may contribute significantly to enhancement of structural uniformity and minimization of field defects. It will also be observed that the superposition of the groove 482 onto the shorter aperture 476 renders the rectilinear inside profile of the central electrode section 424 or the entire electrode 400 (depending on the length of the groove 482), from the perspective of the x-z plane facing the interior space 202, uniform along the z-axis, again regardless of whether the aperture 476 is 100% or less than the central electrode section 424. Uniformity may also be improved by extending the groove 482 beyond the central electrode section 424 such that the groove 482 continues over only a portion of the first end electrode section 422 and second end electrode section 426.

Figure 6:
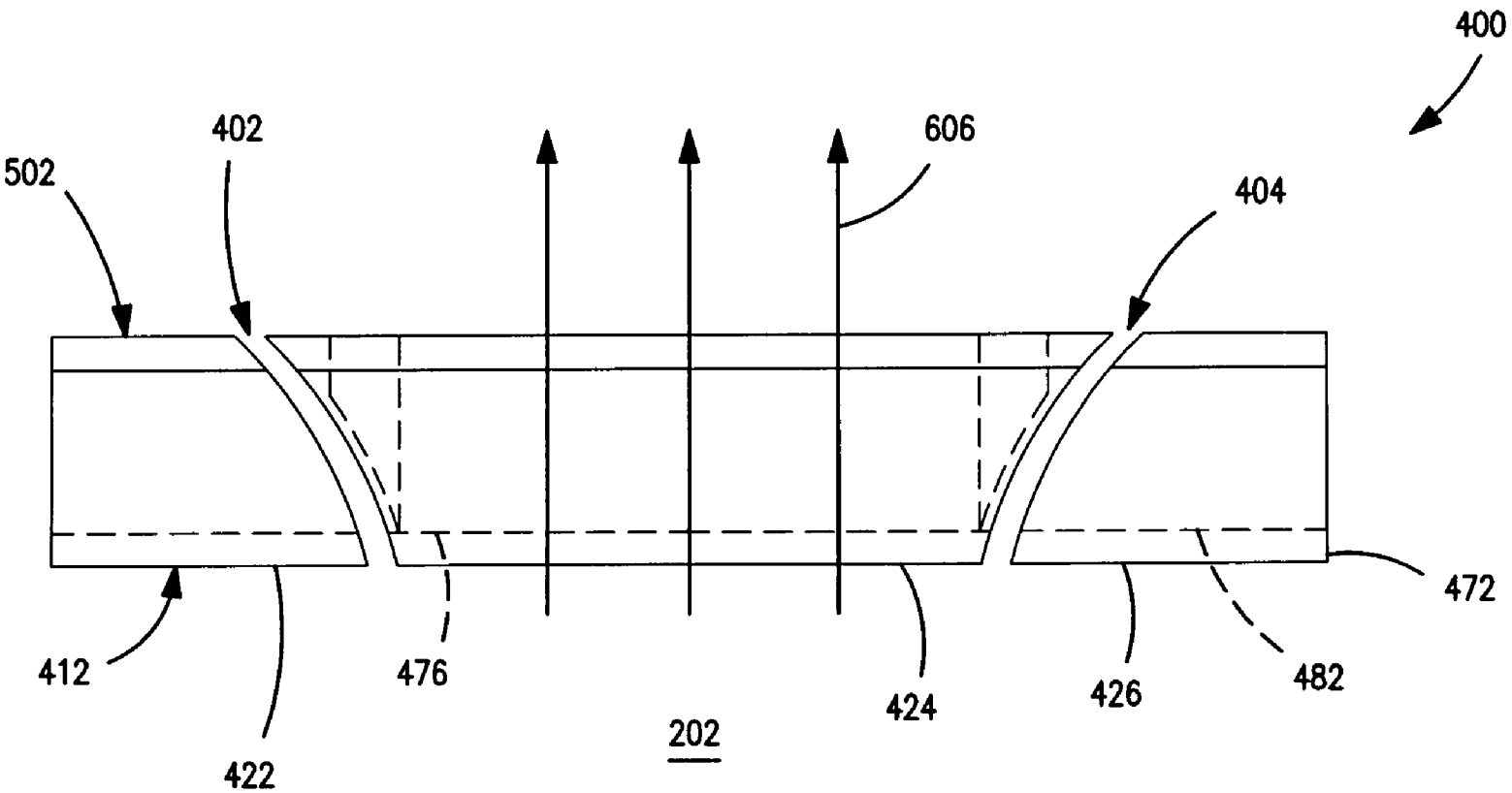
FIG. 6 is a top elevation view of the electrode illustrated in FIGS. 4 and 5.

FIG. 6 is a top elevation view of the electrode 400 illustrated in FIGS. 4 and 5, such that the inside surface 412 faces toward the bottom of the drawing sheet where the interior space 202 of the electrode structure 100 (FIGS. 2 and 3) would be located. FIG. 6 illustrates, through the body or thickness of the electrode 400, the example in which the elongated aperture 476 traverses 100% of the length of the central electrode section 424 and the axial groove 482 traverses 100% of the length of the entire electrode 400 along its apical line 472. It can be observed that the structure or geometry of the electrode 400 apparent to the ions in the interior space 202 is entirely uniform along the length of the electrode 400. From any point of reference within the interior space 202 along the axial length of the electrode 400, there is no physical distinction between the aperture 476 and the groove 482. The gaps 402 and 404 required of the multi-section electrode 400 constitute the only discontinuity. The presence of the axial groove 482 effectively removes any discontinuity that might attend the presence of the aperture 476. Moreover, up to 100% of the aperture 476 may be utilized for ejecting ions, as depicted by the arrows 606, without any appreciable affect from fringe fields.

The implementations described above, including the examples illustrated in FIGS. 4-6, are useful in eliminating or at least significantly minimizing field distortions along the z-axis of the electrode structure 100, including field imperfections in the vicinity of the aperture 476 and fringe fields at the interfacial regions between the central region 124 and the end regions 122 and 126 of the electrode structure 100. In these implementations, one or more axial sections 422, 424 and 426 of the electrode 400 that are exposed to the interior space 202 have the same structural profiles from the perspective of the x-y plane and/or the x-z (or y-z) plane, particularly as regards the apical region of the electrode 400 that extends the farthest into the interior space 202. Due to the elimination or minimization of field imperfections, all ions resident in at least the central region 124 of the electrode structure 100 may have the same response to the fields applied to the electrode structure 100. Thus, mass resolution will not be degraded even with the aperture 476 being present. Moreover, when all electrodes 102, 104, 106 and 108 of the electrode structure 100 are configured with similar elongated surface features, the entire structural profile presented by the electrode structure 100 is uniform as seen from the interior space 202 and by ions resident in the interior space 202. Thus, implementations described in the present disclosure may enhance the performance of an ion trap or other ion processing device in which one or more of the electrodes 400 are utilized. For instance, these implementations may increase mass resolution and ion signal intensity and minimize the occurrence of peak broadening in mass spectra obtained from MS experiments in which the electrode structure 100 is employed as an ion trap-based mass analyzer.

By comparison, in embodiments of the prior art in which the length of the aperture is significantly shorter than the length of the central electrode section or which lack an elongated surface feature such as the groove 482, the axial terminations (edges) of the aperture present geometrical discontinuities in addition to the terminations (end faces or axial edges) of the central electrode section. Consequently, mass resolution is still degraded even though the length of the aperture may have been specified at some desired percentage of the overall length of the electrode section in which the aperture is formed. By contrast, in some implementations of the electrode 400 such as illustrated in FIGS. 4-6, the terminations of the aperture 476 coincide with the terminations of the central electrode section 424 and thus the configuration of the electrode 400 removes at least some of the geometrical discontinuities necessitated by the inclusion of the aperture 476.

It will be noted that the entire axial length of an extended-length aperture 476 need not be employed for the ejection of ions from the interior space 202 of the electrode structure 100 (FIGS. 2 and 3). Because the DC voltage level can be individually tailored at each of the separate electrode regions 422, 424, and 426, an axial DC potential well may be generated such that the motions of ions along the z-axis are confined to a central sub-region of the central electrode sections 424, far enough away from the axial interfaces between the central electrode sections 424 and the end electrode sections 422 and 426 to avoid any remaining field perturbations that might adversely affect the processing and manipulation of ions. However, in the implementations illustrated in FIGS. 4-6, all or most of the 100%-length aperture 476 may be utilized for ion ejection without any appreciable adverse effects from field faults.

Figure 7:
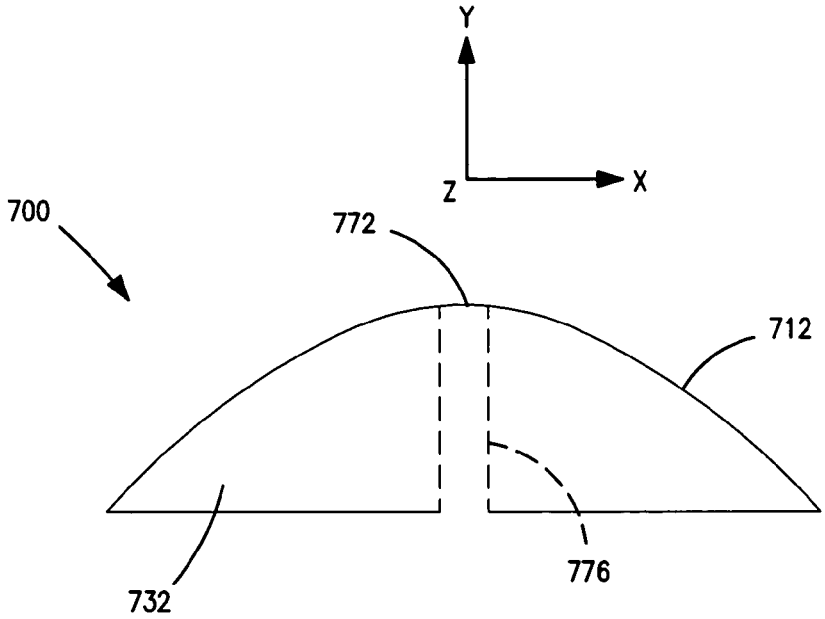
FIG. 7 PRIOR ART
FIG. 7 is an end elevation view of a known electrode.
Figure 8:
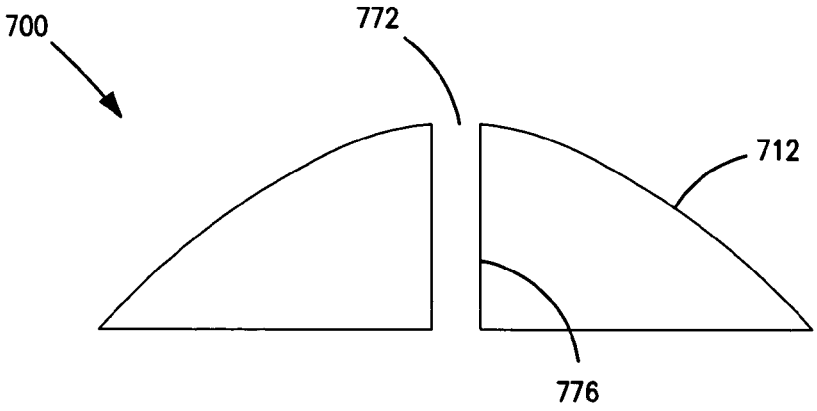
FIG. 8 PRIOR ART
FIG. 8 is a cross-sectional view of the electrode illustrated in FIG. 7.

FIGS. 7-10 further illustrate advantages provided by improving the uniformity of electrode surfaces to which ions are exposed during ion processing operations. FIGS. 7 and 8 are simplified cross-sectional views of an electrode 700 (or the central section of a segmented electrode) having a typical configuration of the prior art. FIG. 7 illustrates an end face 732 of the electrode 700. As indicated by phantom lines, an aperture 776 is formed through the radial thickness (here, in the y-direction) of the electrode 700 at an axial (z) distance from the end face 732 (in the direction into the drawing sheet), and is centered at the apex 772 of the curved inside surface 712. The profile of the inside surface 712 is continuous or uninterrupted as one moves axially along the electrode 700 from the end face 732 to the point or plane at which the aperture 776 is present. By comparison, FIG. 8 illustrates the cross-section of the electrode 700 at the point or plane at which the aperture 776 begins. In the region of the electrode 700 where the aperture 776 is present, the outward profile of the inside surface 712, which in practice would face the ion-occupied volume of an associated ion-processing device such as an ion trap, is now discontinuous due to the space or gap created by the aperture 776. The surface profile is also discontinuous relative to the region represented in FIG. 7 where no aperture 776 is present and thus where the body of the electrode 700 is solid throughout the cross-sectional x-y plane. Moreover, the transition from the continuous surface profile to the discontinuous surface profile is necessarily abrupt. Accordingly, the surface profile of the electrode 700 lacks uniformity due to the edges of the aperture 776. As a result, ions in the vicinity of the region of the electrode 700 shown in FIG. 7 will experience different electrical or magnetic field effects as compared to ions in the vicinity of the region of the electrode 700 shown in FIG. 8.

Figure 9:
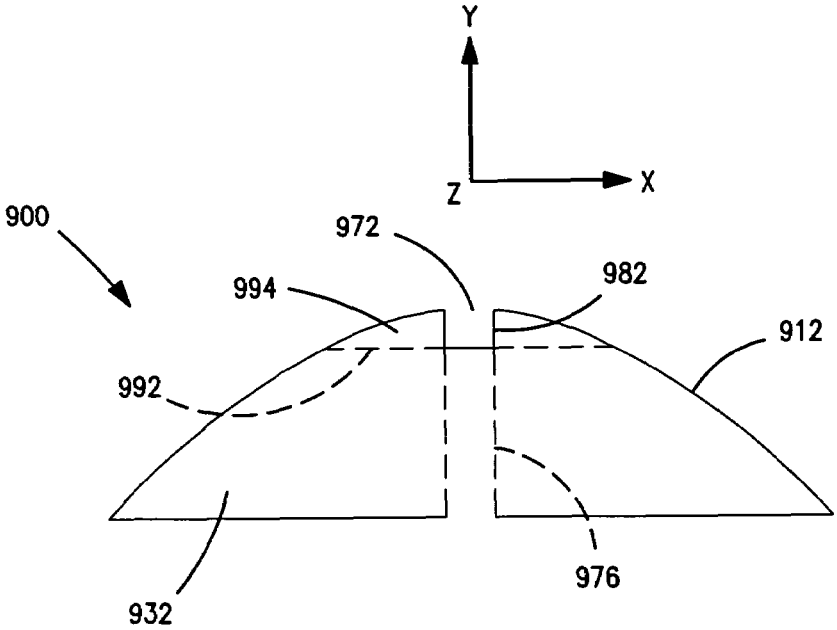
FIG. 9 is an end elevation view of another example of an electrode provided in accordance with implementations described in the present disclosure.
Figure 10:
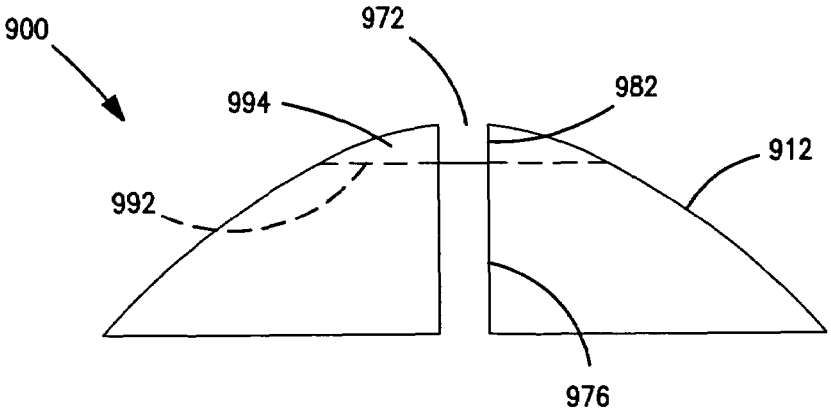
FIG. 10 is a cross-sectional view of the electrode illustrated in FIG. 9.

By comparison, FIGS. 9 and 10 are simplified cross-sectional views of an electrode 900 (or the central section of a segmented electrode) configured according to implementations described in the present disclosure in which a 100%-length aperture and/or a groove are provided. FIG. 9 illustrates an end face 932 of the electrode 900. A groove 982 begins at the end face 932 and is centered about the apex 972 of the curved inside surface 912 of the electrode 900. As indicated by phantom lines, if the electrode 900 is fabricated as an apertured electrode, an aperture 976 is additionally formed at an axial (z) distance from the end face 932 and is likewise centered at the apex 972 of the inside surface 912. The width (here, in the x-direction) of the aperture 976 may be the same or approximately the same as the width of the groove 982.

The groove 982 in this example spans the entire axial length of the electrode 900 (or the central section of a segmented electrode). Thus, it will be understood that the cross-section of the electrode 900 at the opposing end face can be a mirror image of that shown in FIG. 9. Like the aperture 776 illustrated in FIGS. 7 and 8, the groove 982 breaks the continuity of the inside surface 412. However, because the groove 982 extends from one axial end of the electrode 900 to the other axial end, this discontinuity of the inside surface 912 does not change over the length of the electrode 900. Thus, the profile of the inside surface 912 remains uniform.

FIG. 10 illustrates the electrode 900 at the point or plane at which the aperture 976 begins. FIG. 10 demonstrates that the profile of the inside surface 912 remains uniform over the entire length of the electrode 900 even along the region of the electrode 900 containing the aperture 976. As a result, ions present on the side of the inside surface 412 of the electrode 900 will encounter the same or approximately the same electrical or magnetic field effects regardless of the axial (z) position of those ions. This is particularly the case where the depth of the groove 982 is selected appropriately, for example about equal to or greater than the width of the groove 982. In the present example, the depth of the groove 982 may be represented by the distance from the apex 972 to the bottom of the groove 982. In FIGS. 9 and 10, the bottom of the groove 982 has been taken to be relatively flat and lies along a conceptual chordal line 992 cutting through the body of the electrode 900. It can also be observed that, in addition to having a uniform surface profile, the electrode 900 has a uniform cross-sectional portion 994 over the axial length of the electrode 900. From the perspective of FIGS. 9 and 10, the cross-sectional portion 994 is generally the portion of the body of the electrode 900 in the x-y plane between the apex 972 and the chordal line 992. It will also be noted that the uniform surface profile and cross-sectional portion 994 may be attained by providing a groove 982 that spans the entire axial length of the electrode 900 in combination with an aperture 976 as illustrated in FIGS. 9 and 10, or just the 100%-length groove 982, or a 100%-length aperture 976 without the groove 982. It can further be observed that one or more other electrodes in an electrode set can be provided with the same uniform surface profile and cross-sectional portion 994, where one or more of the electrodes in the set have an aperture 976 and all or the electrodes have a 100%-length aperture 976 or a 100%-length groove 982.

Figure 11:
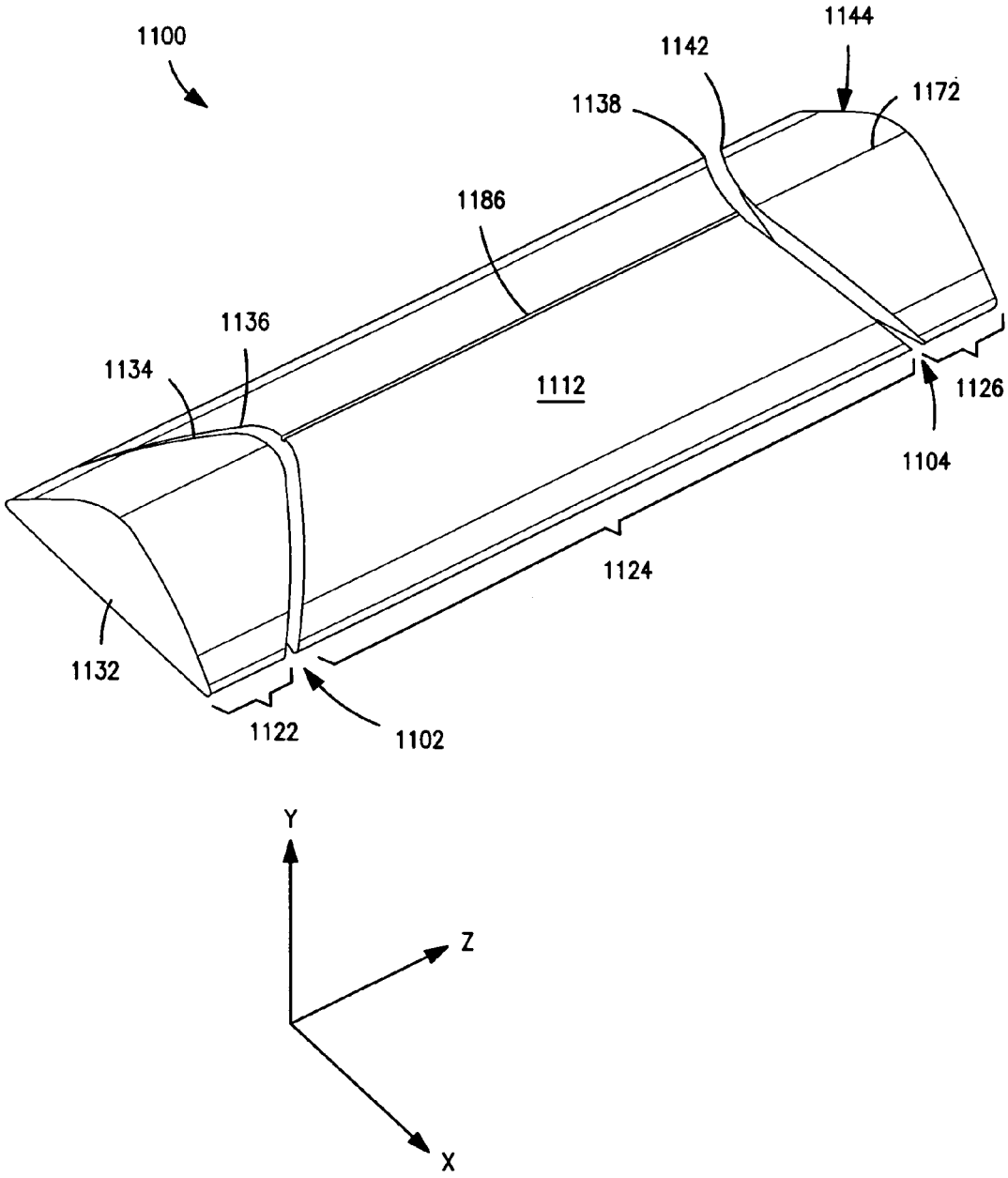
FIG. 11 is a perspective view of another example of an electrode provided in accordance with implementations described in the present disclosure.
Figure 12:
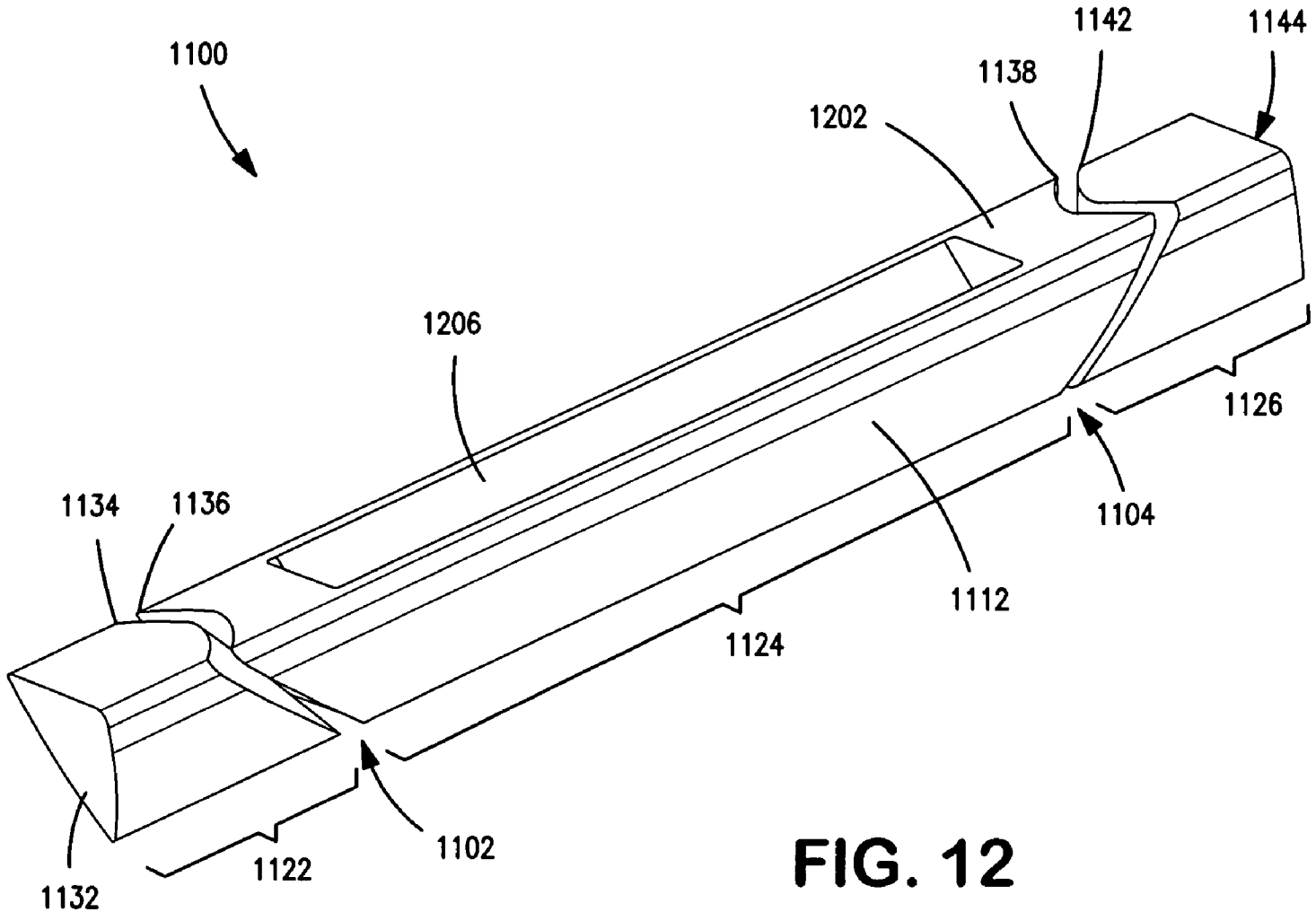
FIG. 12 is a perspective view of the electrode illustrated in FIG. 11, from an opposite side.

FIGS. 11 and 12 are perspective views of an electrode 1100 provided in accordance with another implementation of the present disclosure. Features or elements similar to those illustrated in FIGS. 4-6 are designated by similar reference numerals. FIG. 11 illustrates the electrode 1100 from the perspective of its inside surface 1112 that would face toward the interior space 202 of the electrode structure 100 (FIGS. 2 and 3). FIG. 12 illustrates the electrode 1100 from the perspective of its outside surface 1202 that would face away from the interior space 202. As in the case of the electrode 400 illustrated in FIGS. 4-6, the inside surface 1112 of the electrode 1100 includes an elongated surface feature 1186 positioned along the apical line 1172. The elongated surface feature 1186 may be an aperture that extends along the entire length of the central electrode section 1124 on the side of the inside surface 1112, or a groove that extends along the entire length of the central electrode section 1124 on the side of the inside surface 1112. In the case where the groove is provided, the electrode 1100 may also include an aperture aligned with the groove and typically axially centered relative to the groove. Such an aperture communicates with the groove and provides a pathway for ejected ions to travel from the inside surface 1112 through the radial or transverse thickness of the electrode 1100. In this example, the surface feature 1186 is not continued over the end sections 1122 and 1126. As in the case of the electrode 400 illustrated in FIGS. 4-6, the respective inside axial end faces 1134, 1136, 1138, 1142 of the electrode sections 1122, 1124 and 1126, and thus the resulting gaps 1102 and 1104, are oriented non-perpendicularly, relative to the plane (e.g., the x-y plane) of the electrode 1100 that is orthogonal to the elongated axial dimension (e.g., the z-axis) of the electrode 1100. It will also be noted in this example that the inside end faces 1134, 1136, 1138, 1142 are curved or scalloped instead of lying in a flat plane. This configuration facilitates fabrication of the central section 1124 of the electrode 1100 as a single piece with the surface feature 1186 spanning the entire length of the central section 1124.

Figure 13:
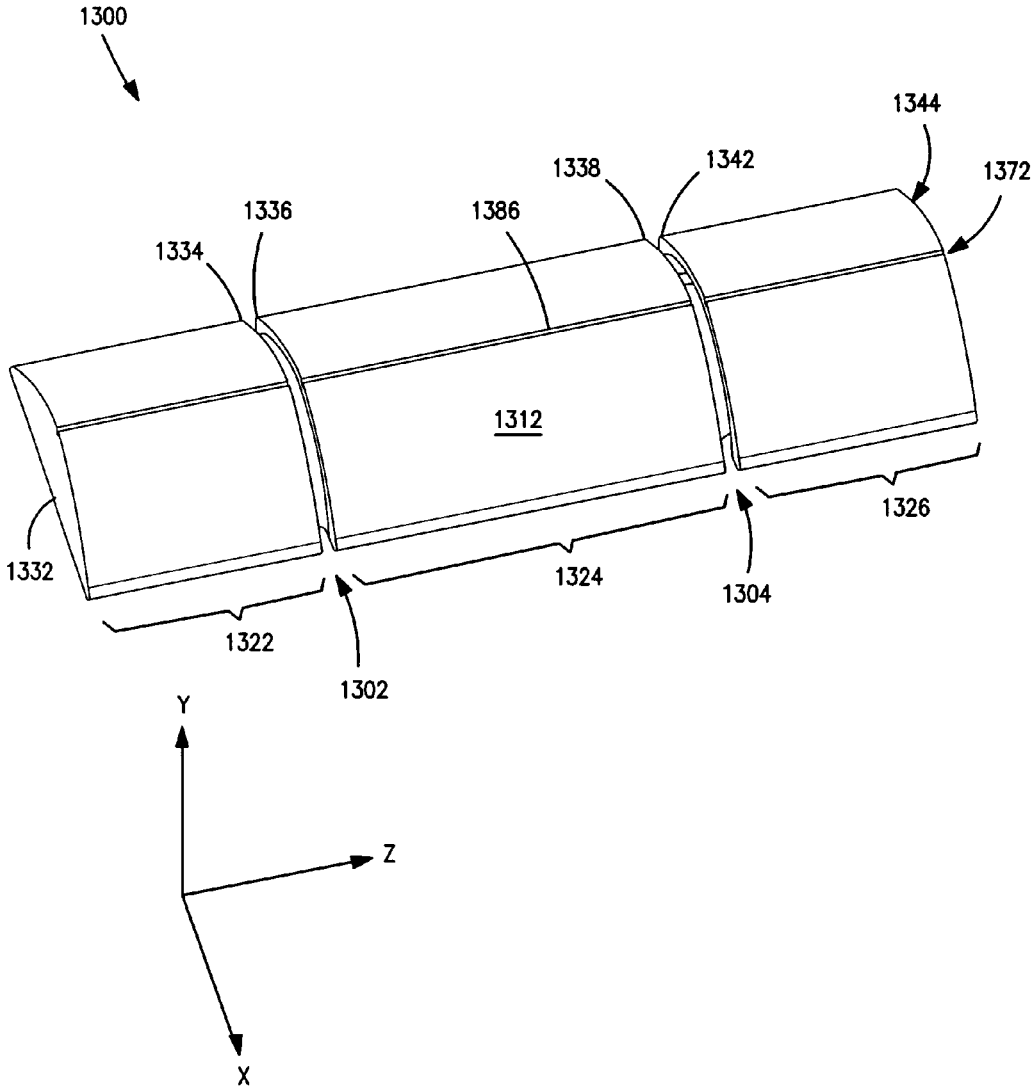
FIG. 13 is a perspective view of another example of an electrode provided in accordance with implementations described in the present disclosure.
Figure 14:
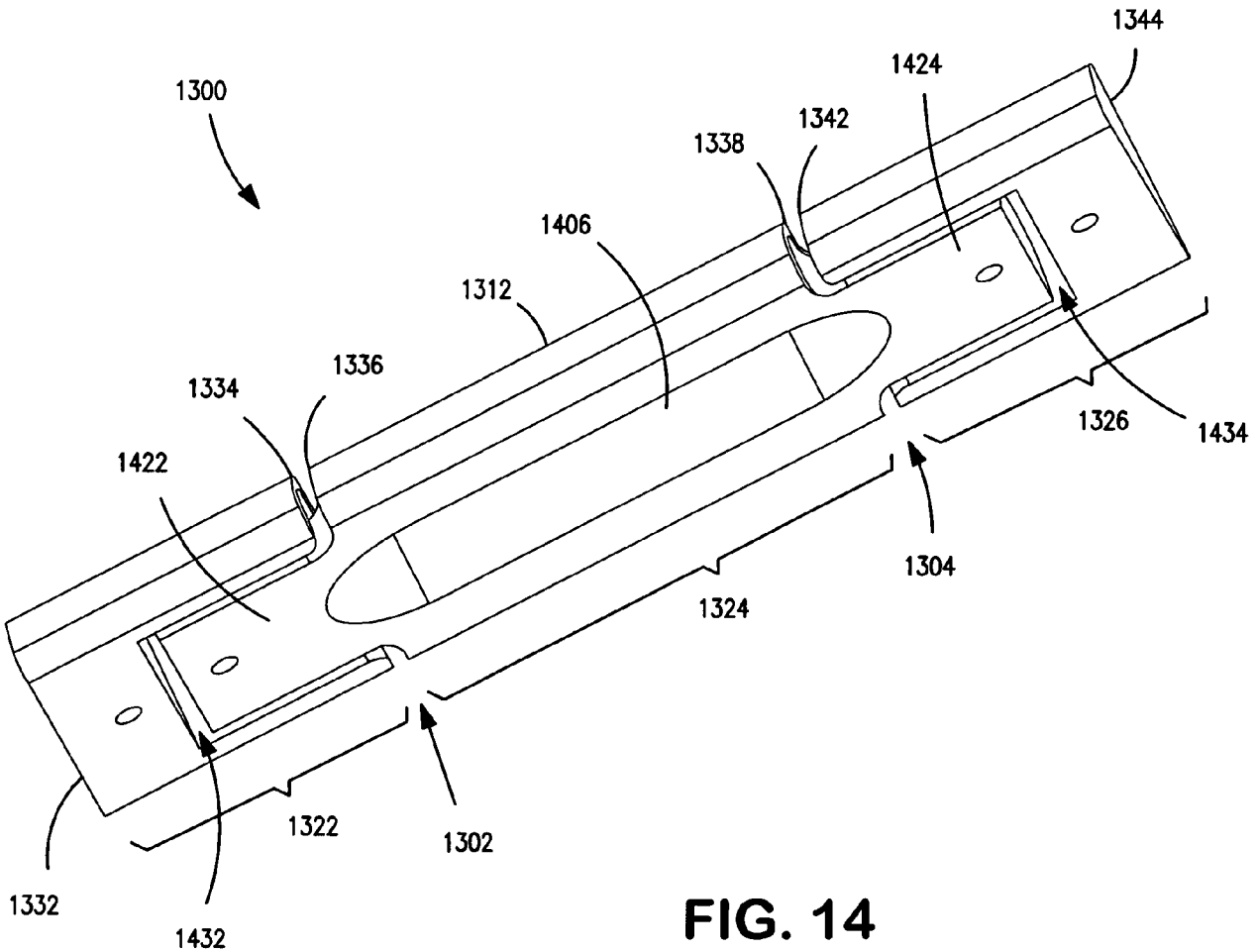
FIG. 14 is a perspective view of the electrode illustrated in FIG. 13, from an opposite side.

FIGS. 13 and 14 are perspective views of an electrode 1300 provided in accordance with another implementation of the present disclosure. Features or elements similar to those illustrated in FIGS. 4-6 are designated by similar reference numerals. FIG. 13 illustrates the electrode 1300 from the perspective of its inside surface 1312 that would face toward the interior space 202 of the electrode structure 100 (FIGS. 2 and 3). FIG. 14 illustrates the electrode 1300 from the perspective of its outside surface 1402 that would face away from the interior space 202. The inside surface 1312 of the electrode 1300 includes an elongated surface feature 1386 positioned along the apical line 1372. The elongated surface feature 1386 may be an aperture that extends along the entire length of the central electrode section 1324 on the side of the inside surface 1312, or a groove that extends along the entire length of the central electrode section 1324 on the side of the inside surface 1312. In the case where the groove is provided, the electrode 1300 may also include an aperture aligned with the groove and extending through the thickness of the electrode 1300. In this example, the surface feature 1386 is continued over the end sections 1322 and 1326. Also in this example, as illustrated in FIG. 14, the electrode 1300 is fabricated and segmented in a manner that results in the central section 1324 having reduced-width end regions 1422 and 1424 and the end sections 1322 and 1326 having complementary recessed or cut-out regions 1432 and 1434 that receive the reduced-width end regions 1422 and 1424, respectively. As a result, at the inside surface 1312 of the electrode 1300 as shown in FIG. 13, the respective inside axial end faces 1334, 1336, 1338, 1342 of the electrode sections 1322, 1324 and 1326, and thus the resulting gaps 1302 and 1304, are oriented perpendicularly relative to the x-y plane. This configuration also facilitates fabrication of the central section 1324 of the electrode 1300 as a single piece with the surface feature 1386 spanning the entire length of the central section 1324.

The electrodes 1100 and 1300 illustrated in FIGS. 11-14 may be, in other aspects, similar to the electrode 400 illustrated in FIGS. 4-6. The electrodes 1100 and 1300 provide the same advantages as described above in conjunction with the electrode 400 illustrated in FIGS. 4-6.

The electrodes described in the present disclosure may be fabricated by any suitable technique. In some implementations, various features of the electrodes may be precision-machined by means of wire electrical discharge machining (EDM). For instance, the utilization of EDM may enable apertures and grooves to be cut during the same processing run. Moreover, this process may ensure that the geometry of the apertures and grooves and the inside-facing profiles of the electrodes are accurately and precisely positioned relative to one another, which is critical for high-resolution performance.

Figure 15:
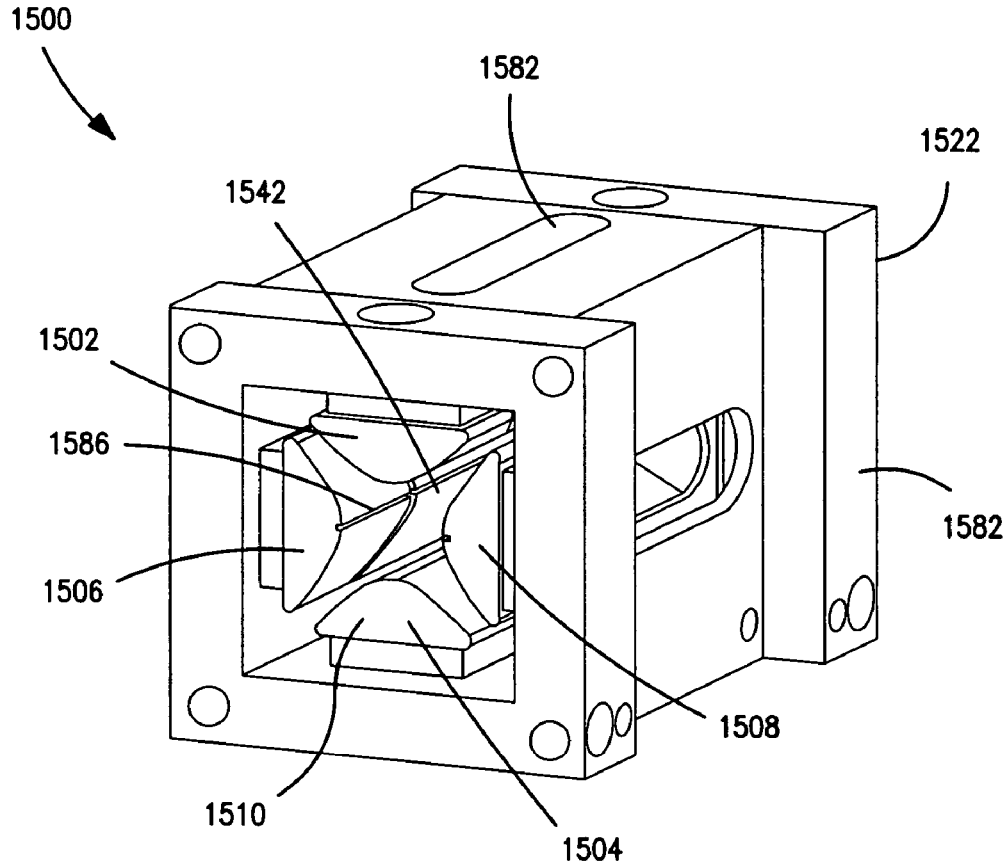
FIG. 15 is a perspective view of an example of an apparatus in which electrodes described in the present disclosure may be implemented.

FIG. 15 is a perspective view of an apparatus 1500 for manipulating or processing ions (such as an ion trap, ion storage apparatus, or the like), or a portion of such an apparatus 1500, which may be provided in accordance with implementations described in the present disclosure. The apparatus 1500 includes a plurality of electrodes 1502, 1504, 1506 and 1508 that form an electrode structure 1510 mounted in a suitable housing 1522. The housing 1522 may be a vacuum chamber or a portion of a vacuum chamber, or may be mounted within a vacuum chamber (not shown). Such a vacuum chamber may be any suitable enclosure that can be evacuated to a desired negative pressure by a suitable pump or other evacuating means. By way of example only, the electrode structure 1510 illustrated in FIG. 15 has a quadrupolar configuration in which four axially elongated and axially segmented electrodes 1502, 1504, 1506 and 1508 are provided as in the case of the electrode structure 100 illustrated in FIGS. 1-3. One or more of the electrodes 1502, 1504, 1506 and 1508 may be configured like any one of the electrodes described above and illustrated in FIGS. 4-6 and 9-14. To accommodate the radial ejection of ions, one or more of these electrodes 1502, 1504, 1506 and 1508 may have an aperture 1542 with an associated channel depth through the thickness of the electrodes 1502, 1504, 1506 and 1508. The housing 1522 may include orifices 1582 aligned with one or more of the apertures 1542 to provide one or more pathways for ejected ions to reach one or more ion detectors (not shown) mounted externally relative to the electrode structure 1510. One or more of the electrodes 1502, 1504, 1506 and 1508 may have a 100%-length or shorter aperture 1542, an elongated surface feature such as an axial groove 1586, or both an aperture 1542 and an axial groove 1586, as described above in conjunction with FIGS. 4-6 and 9-14. Thus, one or more of the electrodes 1502, 1504, 1506 and 1508 may provide the improved geometrical and electrical uniformities described above. The apparatus 1500 may be provided as part of a suitable mass spectrometry-related instrument or system.

Figure 16:
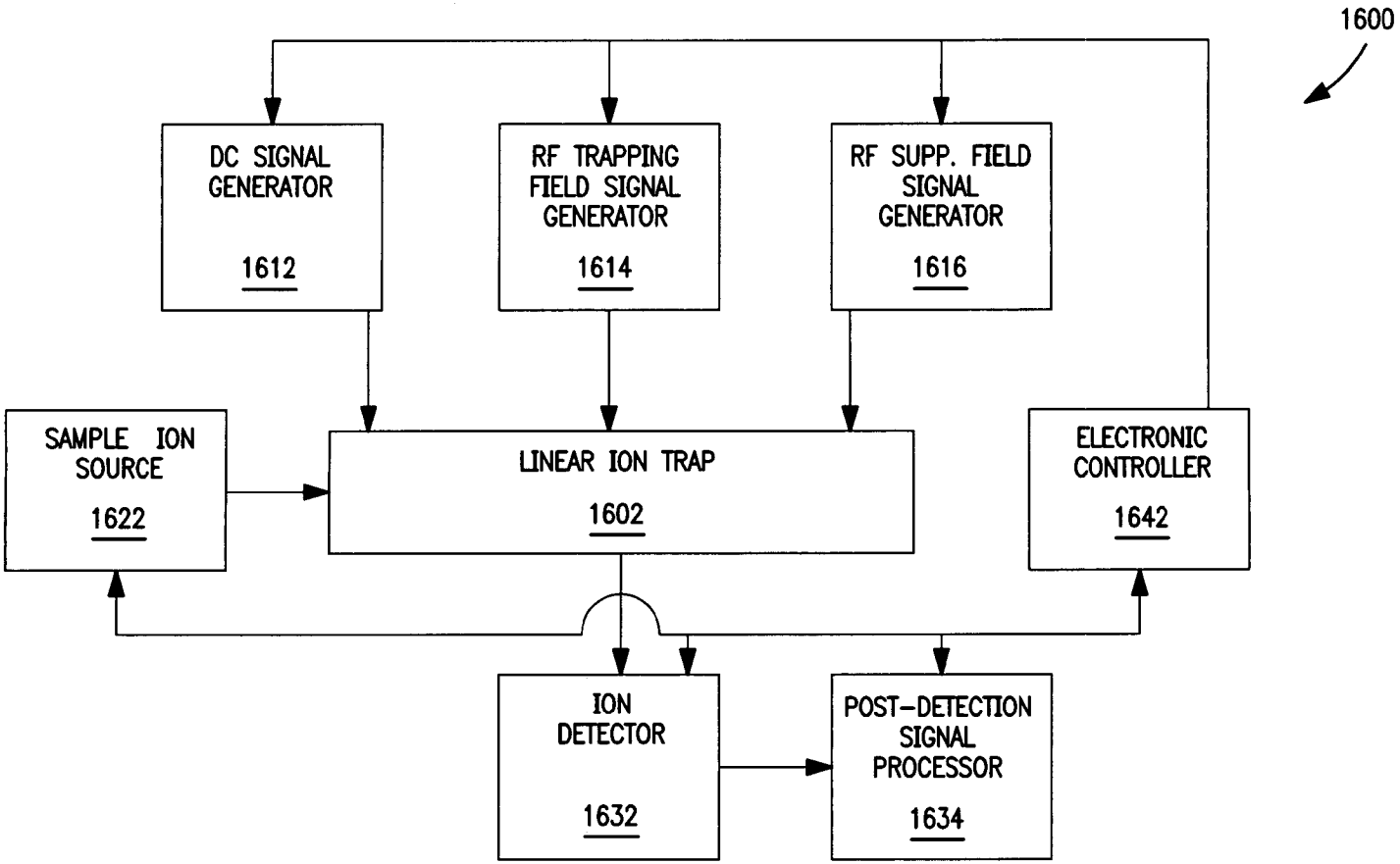
FIG. 16 is a schematic diagram of a mass spectrometry system.

FIG. 16 is a highly generalized and simplified schematic diagram of an example of a linear ion trap-based mass spectrometry (MS) system 1600. The MS system 1600 illustrated in FIG. 16 is but one example of an environment in which implementations described in the present disclosure are applicable. Apart from their utilization in implementations described in the present disclosure, the various components or functions depicted in FIG. 16 are generally known and thus require only brief summarization.

The MS system 1600 includes a linear or two-dimensional ion trap 1602 that may include an electrode structure such as the electrode structure 100 or 1510 and associated components and features described above and illustrated in FIGS. 1-6 and 9-15. A variety of DC and AC (RF) voltage sources may operatively communicate with the various conductive components of the ion trap 1602 as described above. These voltage sources may include a DC signal generator 1612, an RF trapping field signal generator 1614, and an RF supplemental field signal generator 1616. A sample or ion source 1622 may be interfaced with the ion trap 1602 for introducing sample material to be ionized in the case of internal ionization or introducing ions in the case of external ionization. One or more gas sources 242 (FIG. 2) may communicate with the ion trap 1602 as previously noted. The ion trap 1602 may communicate with one or more ion detectors 1632 for detecting ejected ions for mass analysis. The ion detector 1632 may communicate with a post-detection signal processor 1634 for receiving output signals from the ion detector 1632. The post-detection signal processor 1634 may represent a variety of circuitry and components for carrying out signal-processing functions such as amplification, summation, storage, and the like as needed for acquiring output data and generating mass spectra. As illustrated by signal lines in FIG. 16, the various components and functional entities of the MS system 1600 may communicate with and be controlled by any suitable electronic controller 1642. The electronic controller 1642 may represent one or more computing or electronic-processing devices, and may include both hardware and software attributes. As examples, the electronic controller 1642 may control the operating parameters and timing of the voltages supplied to the ion trap 1602 by the DC signal generator 1612, the RF trapping field signal generator 1614, and the RF supplemental field signal generator 1616. In addition, the electronic controller 1642 may execute or control, in whole or in part, one or more steps of the methods described in the present disclosure.

It will be understood that the methods and apparatus described in the present disclosure may be implemented in an MS system 1600 as generally described above and illustrated in FIG. 16 by way of example. The present subject matter, however, is not limited to the specific MS system 1600 illustrated in FIG. 16 or to the specific arrangement of circuitry and components illustrated in FIG. 16. Moreover, the present subject matter is not limited to MS-based applications.

The subject matter described in the present disclosure may also find application to ion traps that operate based on Fourier transform ion cyclotron resonance (FT-ICR), which employ a magnetic field to trap ions and an electric field to eject ions from the trap (or ion cyclotron cell). The subject matter may also find application to static electric traps such as described in U.S. Pat. No. 5,886,346. Apparatus and methods for implementing these ion trapping and mass spectrometric techniques are well-known to persons skilled in the art and therefore need not be described in any further detail herein.

It will be further understood that various aspects or details of the invention may be changed without departing from the scope of the invention. Furthermore, the foregoing description is for the purpose of illustration only, and not for the purpose of limitation—the invention being defined by the claims.

What is claimed is:

1. An electrode structure for manipulating ions, comprising:

a plurality of electrodes coaxially disposed about a central axis, each electrode having an axial length extending generally in the direction of the central axis, each electrode including a first axial end, a second axial end and segmented into a first end section, a central section and a second end section axially spaced therebetween, an outside surface generally facing away from an interior space of the electrode structure, and an inside surface generally facing the interior space and axially extending from the first axial end to the second axial end, wherein:

at least one of the electrodes is an apertured electrode having an aperture radially extending from the inside surface to the outside surface; and the inside surface of the apertured electrode includes a surface profile, the surface profile includes an apical region generally centered about the aperture and axially extending from the first axial end to the second axial end, the surface profile in the apical region is uniform along the axial direction from the first axial end to the second axial end of the central section of the apertured electrode, and the uniformity of the surface profile continues along the axial direction over at least a portion of the first end section of the apertured electrode nearest to the first axial end of the center section and over at least a portion of the second end section of the apertured electrode nearest to the second axial end of the center section.

2. The electrode structure of claim 1, wherein the inside surface of the apertured electrode includes an elongated surface feature extending from the first axial end to the second axial end.

3. The electrode structure of claim 2, wherein the elongated surface feature includes a groove radially extending into the apertured electrode and communicating with the aperture.

4. The electrode structure of claim 3, wherein the axial length of the groove is greater than the axial length of the aperture.

5. The electrode structure of claim 1, wherein the aperture axially extends from the first axial end to the second axial end of the central section of the apertured electrode.

6. The electrode structure of claim 1, wherein the inside surface of the apertured electrode includes an elongated surface feature extending from the first axial end to the second axial end of the center section, and over at least the portion of the first end section nearest to the first axial end and over at least the portion of the second end section nearest to the second axial end.

7. The electrode structure of claim 1, wherein the elongated surface feature includes a groove radially extending into the apertured electrode and communicating with the aperture.

8. The electrode structure of claim 1, wherein the uniformity of the surface profile continues along the axial direction over the entire length of the first end section of the apertured electrode and over the entire length of the second end section of the apertured electrode.

9. The electrode structure of claim 1, wherein at least a portion of the surface profile of the apertured electrode is generally hyperbolic.

10. The electrode structure of claim 1, wherein the plurality of electrodes includes an opposing electrode disposed opposite to the apertured electrode relative to the central axis, the inside surface of the opposing electrode includes an opposing surface profile including and opposing apical region, and the opposing surface profile in the apical region is uniform along the axial direction from the first axial end to the second axial end of the opposing electrode.

11. The electrode structure of claim 1, wherein the apertured electrode includes a cross-sectional portion in a plane orthogonal to the central axis and defined by a radial axis and a transverse axis, the cross-sectional portion has a width along the transverse axis and a depth along the radial axis, the cross-sectional portion is generally centered about the aperture and axially extends from the first axial end to the second axial end of the apertured electrode, and the cross-sectional portion is uniform along the axial direction from the first axial end to the second axial end.

12. The electrode structure of claim 1, wherein:

the apertured electrode includes a cross-section in a plane facing the interior space and defined by the axial length of the apertured electrode and a transverse axis oriented orthogonally relative to the central axis, and the cross-section has a width along the transverse axis;

the plurality of electrodes includes an opposing electrode disposed opposite to the apertured electrode relative to the central axis, and the opposing electrode includes a cross-section in a plane facing the interior space and opposite to the cross-section of the apertured electrode; and the respective cross-sections of the apertured electrode and the opposite electrode are the same along the axial direction from the first axial ends to the second axial ends of the respective apertured electrode and the opposite electrode.

13. An electrode for generating an electric field in an ion processing device, the electrode comprising:

a body including a first axial end, an opposing second axial end, an elongated length extending from the first axial end to the second axial end, a thickness lying in a cross-sectional plane orthogonal to the elongated length, and an outer surface extending from the first axial end to the second axial end, the outer surface including a curved section extending from the first axial end to the second axial end, wherein:

the body is segmented into a first end section, a central section axially spaced from the first end section by a first gap, and a second end section axially spaced from the central section by a second gap; and at least a portion of the first gap and at least a portion of the second gap are oriented at an oblique angle relative the cross-sectional plane.

14. The electrode of claim 13, wherein the curved section includes an elongated surface feature axially extending along the entire length of the central section.

15. The electrode of claim 13, wherein:

the first end section includes a first end section inside face, the central section includes a first central section inside face and an opposing second central section inside face, and the second end section includes a second end section inside face;

the first end section inside face is separated from the first central section inside face by the first gap, and the second end section inside face is separated from the second central section inside face by the second gap; and each of the first end section inside face, the first central section inside face, the second central section inside face, and the second end section inside face is curved relative to the orthogonal plane.

16. The electrode of claim 13, wherein the central section includes a first reduced-width end region and an opposing second reduced-width end region, the first end section includes a first recessed region receiving the first reduced-width end region and separated from the first reduced-width end region by the first gap, and the second end section includes a second recessed region receiving the second reduced-width end region and separated from the second reduced-width end region by the second gap.

17. An electrode structure for manipulating ions, comprising:

a plurality of electrodes coaxially disposed about a central axis and forming an interior space, each electrode having an axial length extending along the central axis and comprising a first axial end, a second axial end, an outside surface and inside surface facing respectively from and towards the interior space; and a single electrode of said plurality having an aperture axially extending from the first axial end to the second axial end and radially extending from the inside surface to the outside surface, wherein a surface profile within the inside surface comprising an apical region generally centered about the aperture, axially extending from the first axial end to the second axial end in the axial direction and being uniform along said apical region.

18. The electrode structure of claim 17, comprising a first end electrode section and a second end electrode section axially spaced from the first end electrode section along the central axis, wherein the plurality of electrodes is axially interposed between the first end electrode section and the second end electrode section.

19. The electrode structure of claim 18, wherein the inside surface of the single electrode includes an elongated surface feature extending from the first axial end to the second axial end.

20. The electrode structure of claim 19, wherein the elongated surface feature includes a groove radially extending into the single electrode and communicating with the aperture.

21. The electrode structure of claim 20, wherein the axial length of the groove is greater than the axial length of the aperture.

* * * * *